US007684735B2

(12) United States Patent
Ino et al.

(10) Patent No.: US 7,684,735 B2
(45) Date of Patent: Mar. 23, 2010

(54) CHARGING APPARATUS AND IMAGE FORMING APPARATUS

(75) Inventors: Toshiaki Ino, Kyoto (JP); Syouichi Fujita, Kashiba (JP); Yasuhiro Nishimura, Takaishi (JP); Susumu Murakami, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 175 days.

(21) Appl. No.: 11/905,711

(22) Filed: Oct. 3, 2007

(65) Prior Publication Data

US 2008/0080896 A1 Apr. 3, 2008

(30) Foreign Application Priority Data

Oct. 3, 2006 (JP) ..... P2006-272265

(51) Int. Cl.
*G03G 15/02* (2006.01)

(52) U.S. Cl. ..... 399/173; 399/171; 399/172

(58) Field of Classification Search ..... 399/170, 399/171, 173, 168
See application file for complete search history.

(56) References Cited

U.S. PATENT DOCUMENTS

2006/0062596 A1* 3/2006 Deguchi et al. ..... 399/171

FOREIGN PATENT DOCUMENTS

| | | |
|---|---|---|
| JP | 4-133257 U | 12/1992 |
| JP | 9-114188 | 5/1997 |
| JP | 10-090974 | 4/1998 |
| JP | 11-040316 | 2/1999 |
| JP | 2006-201488 | 8/2006 |

* cited by examiner

*Primary Examiner*—David M Gray
*Assistant Examiner*—Gregory H Curran
(74) *Attorney, Agent, or Firm*—Nixon & Vanderhye, PC

(57) ABSTRACT

A charging apparatus having a corona electrode is provided which exhibits high durability against ozone and moisture in the air, which can charge a surface of a photoreceptor drum stably throughout the life of an image forming apparatus, and which can be manufactured at a low cost. In a charging apparatus including corona electrode having a flat plate section and a pointed projection section, a support member, a shield case, and a grid electrode, a coating layer including a material different from the material of the corona electrode is formed at least on part of the surface of pointed projections constituting the pointed projection section.

9 Claims, 7 Drawing Sheets

CHARGING APPARATUS AND IMAGE FORMING APPARATUS

CROSS-REFERENCE TO RELATED APPLICATION

This application claims priority to Japanese Patent Application No. 2006-272265, which was filed on Oct. 3, 2006, the contents of which are incorporated herein by reference in its entirety.

BACKGROUND OF THE TECHNOLOGY

1. Field of the Technology

The present technology relates to a charging apparatus and an image forming apparatus.

2. Description of the Related Art

An electrophotographic image forming apparatus (hereinafter simply referred to as "image forming apparatus") has been widely spread in the form of, for example, copiers, printers, and facsimile apparatus because they allow images of high quality to be formed through simple operations in a short time and because they can be easily maintained and managed. For example, an electrophotographic image forming apparatus includes a photoreceptor drum, a charging apparatus, an exposure section, a developing section, a transfer section, and a fixing section. The photoreceptor drum is a member in the form of a roller having a photosensitive layer on a surface thereof. A charging apparatus charges the surface of the photoreceptor drum at a predetermined electric potential having a predetermined polarity. The exposure section forms an electrostatic latent image on the surface of the photoreceptor drum thus charged. The developing section supplies toner to the electrostatic latent image on the surface of the photoreceptor drum to form a toner image. The transfer section transfers the toner image on the surface of the photoreceptor drum onto a recording medium. The fixing section fixes the toner image on the recording medium. Thus, an image is formed on the recording medium.

A corona charging apparatus including a corona electrode, a grid electrode, shield case, and a support member is primarily used as the charging apparatus included in the image forming apparatus. The corona electrode undergoes corona discharge to charge the surface of the photoreceptor drum at a predetermined electric potential having a predetermined polarity. The grid electrode is provided between the photoreceptor drum and the corona electrode, it adjusts the amount of the charge imparted from the corona electrode to the surface of the photoreceptor drum to control the potential at which the photoreceptor drum surface is charged. The shield case is provided to enclose the corona electrode excluding the space between the corona electrode and the photoreceptor drum. The support member supports the corona electrode and the grid electrode. The corona charging apparatus can control the potential charged on the photoreceptor drum surface substantially at an exact value. For example, a metal plate electrode (hereinafter also referred to as "saw-tooth electrode") having a plurality of needle-like portions (pointed projections) is used as the corona electrode of the corona discharge apparatus. A saw-tooth electrode is more advantageous than a wire electrode or the like in that it has a smaller number of components, has a longer life, generates a smaller amount of ozone, and has less failures such as breakage. A saw-tooth electrode is manufactured by etching a metal plate which is primarily made of an iron-type metal material such as stainless steel or nickel to form a plurality of needle-like portions on the plate. Such a saw-tooth electrode made of an iron-type metal material has a problem in that it is vulnerable to oxidation attributable to ozone generated as a result of corona discharge of the corona electrode, although it has high durability. When a saw-tooth electrode is used for a long time, it may be unavoidable to use the electrode in a highly humid environment (an environment including a relatively great amount of moisture) and to put the electrode in contact with ozone. Moisture and ozone in the air result in corrosion such as rusting, and durability of the electrode is reduced by nitrogen oxides thus deposited on the surface of the same. In addition, the corona discharge from the needle-like portions reduces the controllability of a voltage applied to the saw-tooth electrode. As a result, the potential charged on the surface of the photoreceptor drum becomes uneven. Therefore, it is not possible to always impart a desired charging potential to the surface of the photoreceptor drum stably, which constitutes a problem to be solved.

In consideration to such a problem, proposals have been made to introduce corona charging apparatus including a saw-tooth electrode in which a layer of an ozone-dissolving catalyst is provided on a surface of the saw-tooth electrode excluding the tops (tips) of needle-like portions of the saw-tooth electrode and the neighborhood of the tips (see Japanese Unexamined Patent Publication JP-A 10-090974 (1998) for example). As described in the paragraph [0035] of the publication, the ozone-dissolving catalyst may be a metal oxide or coconut shell-based activated carbon. According to the technique disclosed in JP-A 10-090974, any reduction in the durability of a saw-tooth electrode attributable to ozone is prevented by providing an ozone-dissolving catalyst layer on the saw-tooth electrode excluding the region where corona discharge takes place. However, since the saw-tooth electrode undergoes corona discharge in response to the application of a high voltage, the ozone-dissolving catalyst layer itself is damaged as time passes under the influence of corona discharge, and the ozone-dissolving capability of the layer is reduced. Therefore, according to the technique disclosed in JP-A 10-090974, it is not possible to prevent reduction in the durability of a saw-tooth electrode attributable to ozone throughout the life of an image forming apparatus.

A saw-tooth electrode provided by coating a surface of a nickel plate with a gold plating layer or platinum plating layer is described in paragraph [0041] of JP-A 10-090974. The gold plating layer or platinum plating layer is advantageous in suppressing the generation of ozone and preventing the corrosion of nickel. However, since they are expensive metals, how to control the thickness of films of such metals is a significant problem. From the viewpoint of durability, the effect of preventing ozone generation, and the effect of protecting nickel, it is normally required to form a gold plating layer with a thickness of 0.3 μm or more. However, when the thickness of a gold plating layer is too great, there will be a significant increase in the manufacturing cost of the same. It is therefore required to control the thickness of a gold plating layer accurately such that it will stay in a very narrow range. For this purpose, plating conditions must be strictly controlled, which unavoidably increases the complicatedness of plating operations and results in a significant increase in manufacturing cost.

Proposals have been made to introduce charging apparatus including a saw-tooth electrode and a grid electrode in which a nickel plating layer containing polytetrafluoroethylene particles (hereinafter referred to as "PTFE particles") is provided on at least one side of a needle-like electrode (the nickel plating layer will be hereinafter referred to as "PTFE-containing nickel plating layer") (see Japanese Unexamined Patent Publication JP-A 2006-201488 for example). The PTFE-containing nickel plating layer can prevent the generation of ozone in the vicinity of the saw-tooth electrode to protect the saw-tooth electrode from ozone and moisture in the air, which allows the life of the saw-tooth electrode to be extended. Further, since the PTFE-containing nickel plating layer itself has high durability, the layer will be subjected to substantially no degrading in its function of protecting the saw-tooth electrode even when exposed to corona discharge. However, the saw-tooth electrode protecting function of the PTFE-containing nickel plating layer may be degraded unless PTFE particles are uniformly dispersed in the nickel layer. In order to disperse PTFE particles in the nickel layer uniformly, strict process management must be conducted at the plating process. Therefore, an increase in manufacturing cost is inevitable also when a PTFE-containing nickel plating layer is provided, although the increase is not as great as that in the case of a gold plating layer. Therefore, there are demands for a technique which allows PTFE particles to be reliably and uniformly dispersed in a nickel layer without increasing manufacturing cost or a technique which keeps the saw-tooth electrode protecting function of a nickel layer substantially unaffected even when PTFE particles are not dispersed in the layer uniformly.

SUMMARY OF THE TECHNOLOGY

It is an object of the technology to provide a charging apparatus having high durability against ozone and moisture in the air, which can charge a surface of a photoreceptor drum with stability throughout the life of an image forming apparatus, and which has a corona electrode manufactured at a low cost.

As a result of close studies in consideration to such an object, the inventor has completed the technology based on the finding that it is advantageous to form an ozone protection layer containing a particular material in part of a surface of a corona electrode having pointed projections in improving the durability of the corona electrode, stabilizing a potential discharged by the electrode, and reducing the manufacturing cost of the electrode.

The technology provides a charging apparatus which is to be incorporated into an image forming apparatus having a photoreceptor drum, for forming an image by an electrophotographic method, comprising:

a corona electrode having a pointed projection section for charging a surface of the photoreceptor drum by applying a voltage to the surface through corona discharge and having a coating layer containing a material different from the electrode material of which the corona electrode is formed, the coating layer being provided at least in part of a surface of the corona electrode;

a first power supply for applying a voltage to the corona electrode;

a shield case provided around the corona electrode at an interval from the same to cover at least part of the periphery of the corona electrode excluding the region of a gap between the corona electrode and the photoreceptor drum;

a grid electrode provided between the photoreceptor drum and the corona electrode; and a second power supply for applying a voltage to the grid electrode.

A charging apparatus, which is to be incorporated into an electrophotographic image forming apparatus, comprises a corona electrode, a first power supply, a shield case, a grid electrode, and a second power supply. In the charging apparatus, a coating layer containing a material different from the material of which the corona electrode is formed is provided on at least part of a surface of the corona electrode having a pointed projection section for causing a corona discharge toward a surface of the photoreceptor. In the charging apparatus, the first power supply applies a voltage to the corona electrode. The shield case is provided around the corona electrode at an interval from the same to cover at least part of the periphery of the corona electrode excluding the region of a gap between the corona electrode and the photoreceptor drum. The grid electrode is provided between the photoreceptor drum and the corona electrode. The second power supply applies a voltage to the grid electrode. The coating layer to serve as a corona electrode protecting layer is formed on at least part of a surface of the corona electrode having a pointed projection section. As a result, a corona electrode protecting function is demonstrated to substantially the same degree as that achieved by forming a coating layer on the entire surface of the corona electrode, and the corona electrode has a longer life against expectations. The reason is as follows. In the case that coating is provided on the entire surface, some regions of the coating may have low durability because of non-uniform dispersion of the material. When such regions are deteriorated or damaged as a result of the exposure of the same to a corona discharge or ozone, other regions of the coating also become vulnerable to deterioration. On the contrary, in the case of partial coating, non-uniform dispersion of the material occurs in a much smaller number of regions. Then, even if some regions of the coating are damaged, the remaining regions stick to the corona electrode with strength higher than that in the case of coating on the entire surface, and the partial damage will not be extended throughout the coating layer. As a result, the durability of the coating layer and hence the corona electrode is improved. Since the coating layer is partially provided, the corona electrode can be manufactured without any increase in the manufacturing cost. Therefore, the charging apparatus exhibits high durability against ozone and moisture in the air. Since the corrosion of the apparatus and the deposition of nitrogen oxides on the same is suppressed, the apparatus can charge the surface of the photoreceptor drum with stability throughout the life of an image forming apparatus. In addition, the apparatus can be manufactured at low costs. The formation of a coating layer may result in environment-polluting by-products such as toxic gases and waste liquids, and the apparatus is advantageous in this regard in that it allows the amount of environment-polluting substances to be reduced.

Furthermore, it is preferable that the corona electrode is formed of an electrode material which is selected from among nickel, stainless steel, iron, copper, and a copper alloy.

The corona electrode is preferably formed of an electrode material which is selected from among nickel, stainless steel, iron, copper, and a copper alloy. Since those materials have high durability and relatively high moldability, they are adequate for the corona electrode having a pointed projection section.

Further, it is preferable that the corona electrode includes a flat plate section extending to be long in one direction and a pointed projection section formed to project from one widthwise end face of the flat plate section, to the widthwise direction, and a coating layer is formed on at least part of the pointed projection section.

It is preferable to employ a configuration in which the corona electrode includes a plate portion extending to be long in one direction and a pointed projection section formed to project from one widthwise end face of the plate portion, to the widthwise direction and in which a coating layer is formed on at least part of the pointed projection section. Since the pointed projection section for causing a corona discharge is vulnerable to ozone and moisture, the corona electrode protecting function of the coating layer can be efficiently achieved by forming the coating layer on this part. In addition, the coating layer forming process is simplified, and the amount of the material is reduced, which allows the corona electrode to be manufactured at a manufacturing cost significantly lower than that in the case that the corona electrode is provided with a coating layer covering the entire surface thereof. For example, when the length of the plate section and the length of the pointed projection section are at a ratio of 1:1 in the widthwise direction of the plate portion, the area occupied by the coating layer can be as small as ⅓ or less of that in the case of coating on the entire surface.

Further, it is preferable that the coating layer is provided only on a corona discharge area of the pointed projection section and on the neighborhood of the area.

The coating layer is provided only on the corona discharge area of the pointed projection section and on the neighborhood of the area, which allows the corona electrode protecting function of the coating layer to be more efficiently achieved and the manufacturing cost of the corona electrode to be reduced further without any reduction in the durability of the same.

Further, it is preferable that the coating layer is a nickel layer containing polytetrafluoroethylene particles.

The nickel layer containing polytetrafluoroethylene particles is used as the coating layer. As a result, the corona electrode protecting function of the coating layer can be achieved with higher efficiency, which is advantageous in extending the life of the corona electrode. Since the PTFE-containing nickel layer is provided on part of the surface of the corona electrode, even when there is a region where PTFE particles are unevenly dispersed, any deterioration and defect attributable to exposure a corona discharge, ozone, or moisture in the air occurs only in such a region. Other regions where PTFE particles are uniformly dispersed keep sticking to the surface of the corona electrode because the durability of such regions is kept high even in the presence of such a defective region attributable to non-uniform dispersion. As a result, the defective region is indirectly protected by the regions of uniform dispersion, and the defective region is unlikely to constitute a source of such a reduction in charging performance and durability that charging of the photoreceptor drum surface can be adversely affected. Therefore, high discharging performance can be achieved throughout the life of the charging apparatus. There is no need for managing the coating layer forming process such that PTFE particles will be uniformly dispersed throughout the coating layer, and the amount of PTFE-containing nickel used can be reduced. Therefore, the manufacturing cost can be much smaller than that in the case wherein a PTFE-containing nickel layer is provided on the entire surface of the corona electrode. Further, PTFE particles contained in the layer allows foreign substances deposited on the surface of the PTFE-containing nickel layer to be easily removed through a simple operation.

Further, it is preferable that the coating layer is a layer of gold.

Since a gold layer is used as the coating layer, the coating layer exhibits an excellent corona electrode protecting function, which is advantageous in extending the life of the corona electrode. In this configuration, since the gold layer is provided on part of the corona electrode surface instead of the entire surface, the amount of gold can be kept small enough to avoid an increase in the manufacturing cost without precisely controlling the thickness of the gold layer to keep it in a narrow range. Therefore, there will be no increase in the manufacturing cost attributable to process control.

The technology also provides an image forming apparatus for forming an image by an electrophotographic method, comprising:

a photoreceptor drum having a photosensitive layer for forming an electrostatic latent image on a surface thereof;

a charging section for charging the surface of the photoreceptor drum, the charging section being any one of the charging apparatuses mentioned above;

an exposure section for forming an electrostatic latent image on the surface of the photoreceptor according to image information;

a developing section for supplying toner to the electrostatic latent image on the photoreceptor surface to form a toner image;

a transfer section for transferring the toner image on the photoreceptor surface onto a recording medium; and a fixing section for fixing the toner image on the recording medium.

The technology provides an image forming apparatus in which a photoreceptor drum can be substantially uniformly charged throughout the life of the apparatus to allow images of a certain high level of quality to be stably formed for a long time.

BRIEF DESCRIPTION OF THE DRAWINGS

Other and further objects, features, and advantages of will be more explicit from the following detailed description taken with reference to the drawings wherein.

DETAILED DESCRIPTION

Figure 1:
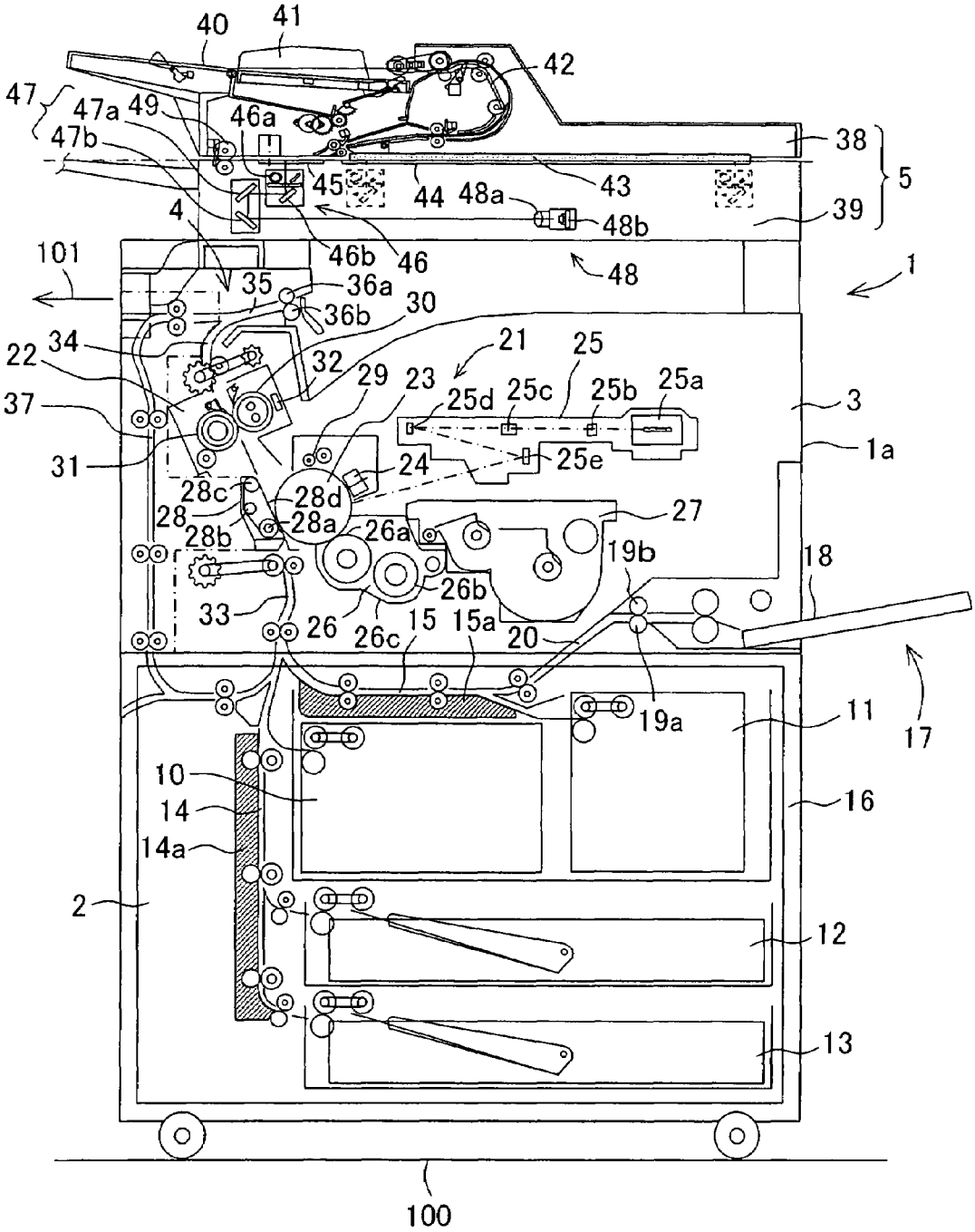
FIG. 1 is a sectional view schematically showing a configuration of an image forming apparatus according to one embodiment.

Now referring to the drawings, preferred embodiments are described below.

Figure 2:
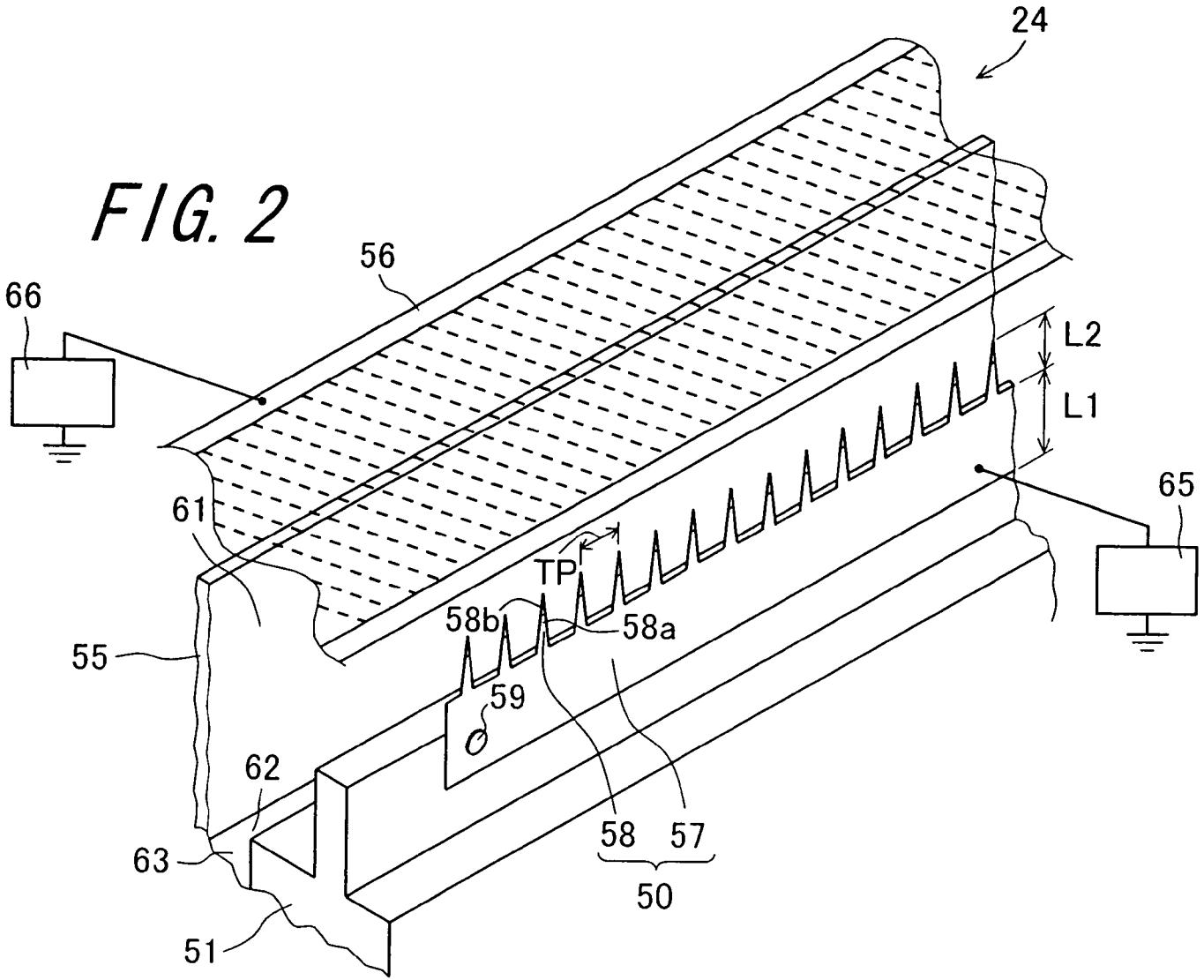
FIG. 2 is a perspective view schematically showing a configuration of a charging apparatus according to another embodiment.
Figure 3:
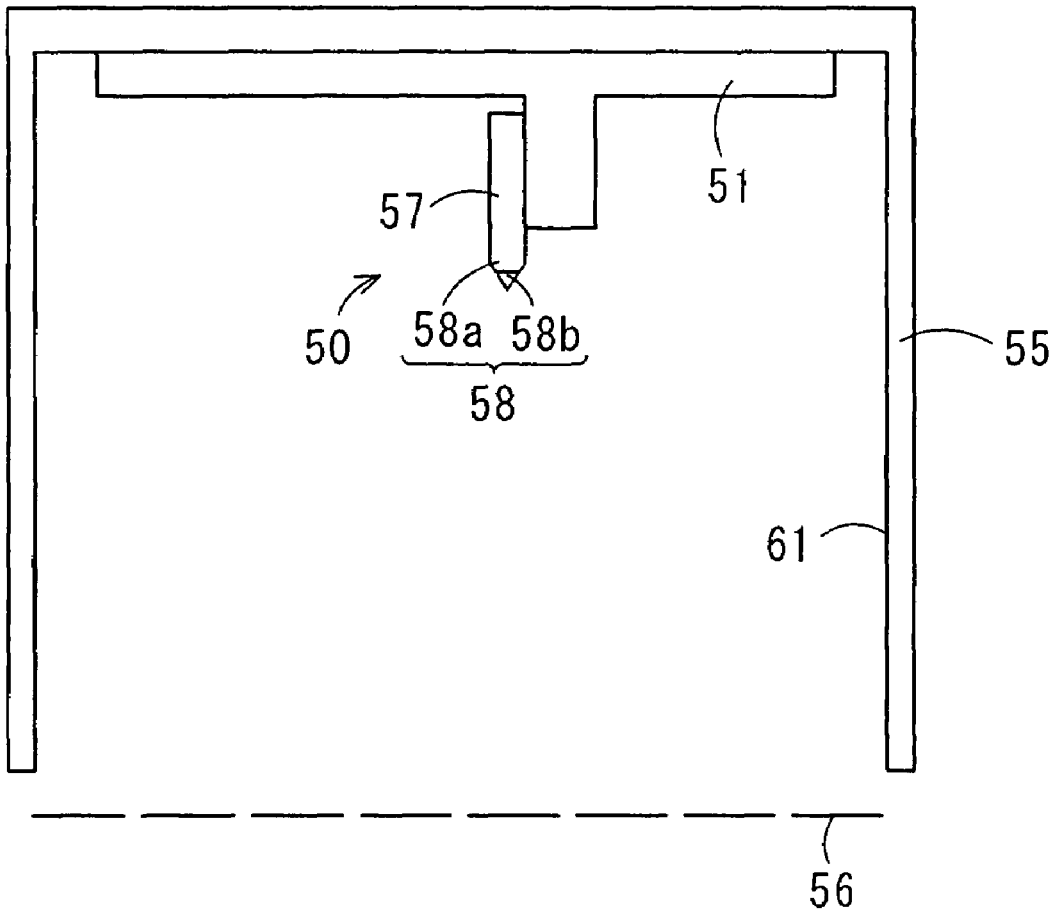
FIG. 3 is a sectional view of the charging apparatus in FIG. 2 showing a configuration of major parts of the same.

FIG. 1 is a sectional view schematically showing a configuration of an image forming apparatus 1 according to one embodiment. FIG. 2 is a perspective view schematically showing a configuration of a charging apparatus 24 according to another embodiment. FIG. 3 is a sectional view of the charging apparatus 24 shown in FIG. 2. The image forming apparatus 1 is a combined machine having the functions of a copier, printer, and a facsimile. The image forming apparatus 1 has three printing modes, i.e., a copier mode (copy mode), a printer mode, and a facsimile mode. An appropriate printing mode is selected by a control section which is not shown when an operation is inputted from an operation unit (not shown) or when a print job is received from an external host apparatus such as a personal computer. The image forming apparatus 1 includes a sheet feeding portion 2, an image forming portion 3, a sheet discharge portion 4, and an original reading portion 5. The sheet feeding portion 2 stores recording media and supplies the recording media to the image forming portion 3. The image forming portion 3 forms images on recording media. The sheet discharge portion 4 discharges the recording media having images formed thereon out of the image forming apparatus 1. The original reading portion 5 reads images and/or characters on an original to be copied, converts the information into electrical signals, and transmits the signals to the image forming portion 3.

The sheet feeding portion 2 includes a sheet feeding trays 10, 11, 12, and 13 (hereinafter referred to as "sheet feeding trays 10 to 13"), first and second conveying paths 14 and 15, a third conveying path 33, a frame 16, and a manual feed section 17. The sheet feeding trays 10 to 13 contain recoding media such as sheets of paper and OHP (overhead projector) films. The sheet feeding trays 10 and 11 are disposed side by side, and the sheet feeding tray 12 is disposed under the trays. Further, the sheet feeding tray 13 is disposed under the tray 12. The sheet feeding trays 10 to 13 are replenished with recording media by pulling out the sheet feeding trays 10 to 13 from the front side (operating side) of the image forming apparatus 1. For example, recording media of different sizes and/or types can be stored in the sheet feeding trays 10 to 13, respectively. The term "sizes" means medium sizes such as A3, A4, B4, and B5 defined in JIS P 0138 or JIS P 0202. The technology is not limited to those sizes, and recording media in undefined shapes may be contained. The term "types" means medium types including sheets of recording paper such as plain paper, color copy paper, coated paper, cardboards, and post cards, the media types also including OHP films. Obviously, recording media of the same type in the same size may be contained in the sheet feeding trays 10 to 13.

The first conveying path 14 is provided so as to extend along the frame 16 in the vertical direction that is perpendicular to a surface 100 on which the image forming apparatus 1 is installed and so as to connect to the third conveying path 33. Thus, the recording media contained in the sheet feeding trays 10, 12, and 13 are fed to the image forming portion 3. The second conveying path 15 is provided so as to extend along the frame 16 of the sheet feeding portion 2 in the horizontal direction that is parallel to the installation surface 100 of the image forming apparatus 1 and so as to connect to the third conveying path 33. Thus, the recording media contained in the sheet feeding tray 11 are fed to the image forming portion 3. Since the sheet feeding trays 10 to 13 and the first and second conveying paths 14 and 15 are disposed in the frame 16 with high spatial efficiency, space-saving can be achieved. The recording media conveyed through the first and second conveying paths 14 and 15 are conveyed to a transfer nip portion, which will be described later, through the third conveying path 33.

The manual feed section 17 is provided vertically above the frame 16, and it includes a manual feed tray 18, feed rollers 19*a* and 19*b*, and a manual feed path 20. The manual feed tray 18 is secured above the frame 16 in the image forming apparatus 1, and the tray is disposed such that part of the same projects outwardly from a side surface 1*a* of the image forming apparatus 1. The manual feed tray 18 is provided such that it can be contained in the image forming apparatus 1. An original document having image information formed thereon is placed in the manual feed tray 18, and the original document is supplied into the image forming apparatus 1. The feed rollers 19*a* and 19*b* feed the recording media placed in the manual feed tray 18 into the image forming apparatus 1. The feed rollers 19*a* and 19*b* are pressed into contact with each other, and each of the rollers is disposed such that it can be rotated about an axis by a driving mechanism which is not shown. When a recording medium is supplied from the manual feed tray 18 to the region where the feed rollers 19*a* and 19*b* are pressed into contact with each other, the medium is sent to the manual feed path 20 by the rotation of the feed rollers 19*a* and 19*b*. The manual feed path 20 is provided such that it extends through the frame 16 and connects to the second conveying path 15. The recording medium which has been fed into the image forming apparatus 1 by the feed rollers 19*a* and 19*b* is conveyed to the image forming portion 3 through the second conveying path 15 and the third conveying path 33. The manual feed section 17 allows the recording medium placed in the manual-insertion tray 18 to be fed into the manual feed path 20 with the feed rollers 19*a* and 19*b* and further allows the media to be sent to the image forming portion 3 through the second conveying path 15.

When images are to be formed on recording media, a tray containing recording media of a prescribed size and type is selected from among the sheet feeding trays 10 to 13 of the sheet feeding portion 2. Each sheet of the recording media in the tray is separated and fed to the image forming portion 3 through either the first conveying path 14 or the second conveying path 15 to form an image on the sheet. A recording medium supplied from the manual feed section 17 is similarly fed to the image forming portion 3 to form an image on the same.

The image forming portion 3 includes an electrophotographic process section 21 and a fixing section 22. The electrophotographic process section 21 includes a photoreceptor drum 23, a charging apparatus 24, a light-scanning unit 25, a developing unit 26, a developer reservoir unit 27, a transfer unit 28, and a cleaning unit 29. The electrophotographic process section 21 transfers a toner image formed according to image information onto a recording medium.

The photoreceptor drum 23 is a member which is provided such that it can be rotated about an axis by a driving mechanism (not shown) and which includes a conductive substrate and a photosensitive layer. There is no particular restriction on the conductive substrate other than that it should have conductivity. For example, usable conductive substrates include substrates having cylindrical or columnar shapes and substrates in the form of a thin-film sheet. Preferably, the conductive substrate has a cylindrical shape. The conductive substrate may be formed using a conductive material that is normally used in this technical field. For example, usable materials include metals such as aluminum, copper, brass, zinc, nickel, stainless steel, chromium, molybdenum, vanadium, indium, titanium, gold, and platinum; alloys composed of two or more of those metals; conductive films provided by forming a conductive layer on a film-like substrate such as a synthetic resin film, a metal film or paper, the conductive layer being made of one type of substance or two or more types of substances among aluminum, an aluminum alloy, a tin oxide, gold, and an indium oxide; and resin compounds containing conductive particles and/or conductive polymer. The film-like substrate used for the conductive film is preferably a synthetic resin film and, in particular, a polyester film is preferred. The conductive layer of the conductive film is preferably formed using vacuum deposition or coating.

For example, the photosensitive layer may be a photosensitive layer having two separate layers provided by stacking a charge generating layer containing a charge generating substance and a charge transporting layer containing a charge transporting substance. The charge generating layer is primarily composed of a charge generating substance which generates an electrical charge when irradiated with light, and a well-known binding resin, plasticizer, and sensitizer are contained in the layer as occasion demands. The charge generating substance may be a substance that is normally used in the technical field. For example, substances which can be used include perylene pigments such as peryleneimide and perylenic acid anhydride; polycyclic quinone pigments such as quinacridone and anthraquinone; phthalocyanine pigments such as metal-phthalocyanine, metal-free phthalocyanine, and halogenized metal-free phthalocyanine; squarium dyes; azulenium dyes; thiapyrylium dyes; and azo pigments having a carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton or distyrylcarbazole skeleton. Among such substances, metal-free phthalocyanine pigments, oxotitanyl phthalocianine pigments, bisdiazo pigments having a fluoren ring and/or fluorenone ring, bisazo pigments composed of aromatic amines, and trisazo pigments are most preferably used to obtain a photosensitive layer having high sensitivity because of their high electrical charge generating capability.

The binding resin for the charge generating layer may be a resin which is normally used in the technical field. For example, resins which can be used include melamine resins, epoxy resins, silicone resin, polyurethanes, acryl resins, vinyl chloride-vinyl acetate copolymer resins, polycarbonates, phenoxy resins, polyvinylbutyrals, polyarilates, polyamides, and polyesters. One type of binding resin may be used alone and, alternatively, two or more types of resins may be used in combination. Although there is no particular restriction on the ratio of the amount of the charge generating substance to the amount of the binding resin, the charge generating substance is used preferably in 5 to 500 parts by weight and more preferably in 10 to 200 parts by weight to 100 parts by weight of the binding resin.

The charge generating layer may be formed as follows. A charge generating substance and a binding resin in respective appropriate amounts are dissolved or dispersed in an appropriate organic solvent in which those components can be dissolved or dispersed, a plasticizer and a sensitizer being added as occasion demands, whereby a coating liquid to provide the charge generating layer is prepared. Then, the coating liquid is applied to a surface of a conductive substrate and dried to form the charge generating layer. Although there is no particular restriction on the thickness of the charge generating layer provided as thus described, the thickness is preferably in the range of from 0.05 to 5 μm and more preferably in the range of from 0.1 to 2.5 μm.

The charge transporting layer is essentially composed of a charge transporting substance capable of accepting and transporting an electrical charge generated by a charge generating substance and a binding resin for the charge transporting layer. A known anti-oxidation agent, plasticizer, sensitizer, and lubricant are contained in the layer as occasion demands. The charge transporting substance may be a substance which is normally used in this technical field. For example, substances which can be used include electron donative substances such as poly-N-vinylcarbazole and derivatives thereof; poly-gamma-carbazolylethylglutamate and derivatives thereof; pyrene-formaldehyde condensates and derivatives thereof; polyvinylpyrene; polyvinylphenanthrene; oxazole derivatives; oxadiazole derivatives; imidazole derivatives; 9-(p-diethylaminostyryl)anthracene; 1,1-bis(4-dibenzylaminophenyl)propane; styrylanthracene; styrylpyrazoline; pyrazoline derivatives; phenylhydrazones; hydrazone derivatives; triphenylamine compounds; tetraphenyldiamine compounds; triphenylmethane compounds; stilbene compounds; and azine compounds having a 3-methyl-2-benzothiazoline ring. Usable substances further include electron-accepting substances such as fluorenone derivatives; dibenzothiophen derivatives; indenothiophen derivatives; phenanthrenquinone derivatives; indenopyridine derivatives; thioxanthon derivatives; benzo[c]cinnoline derivatives; phenazine oxide derivatives; tetracyanoehylnes; tetracyanoquinodimethanes; promanyls; chloranyls; and benzoquinones. One type of charge transporting substance may be used alone and, alternatively, two or more types of such substances may be used in combination.

The binding resin for the charge transporting layer may be a resin which is normally used in this technical field and which is capable of dispersing a charge transporting substance uniformly. For example, resins which can be used include polycarbonates; polyarilates; polyvinylbutyrals; polyamides; polyesters; polyketones; epoxy resins; polyurethanes; polyvinylketones; polystylenes; polyacrylamides; phenol resins; phenoxy resins; polysulfon resins; and copolymers of those resins. Among those resins, a polycarbonate containing bisphenol Z as a monomeric component (hereinafter referred to as "bisphenol Z-type polycarbonate") and a mixture the bisphenol Z-type polycarbonate and another type of polycarbonate are preferred when consideration is paid to the ease of film formation and the abrasion resistance and electrical characteristics of a charge transporting layer obtained from such a mixture. One type of binding resin may be used alone and, alternatively, two or more types of resins may be used in combination. Although there is no particular restriction on the ratio of the amount the binding resin and the amount of the charge transporting substance, the charge generating substance is used preferably in 10 to 300 parts by weight and more preferably in 30 to 150 parts by weight to 100 parts by weight of the binding resin.

The charge transporting layer preferably contains an anti-oxidation agent in addition to the charge transporting substance and the binding resin for the charge transporting layer. The anti-oxidation agent may be an agent which is normally used in this technical field. For example, agents which can be used include vitamin E, hydroquinones, hindered amines, hindered phenols, paraphenylenediamines, arylalcanes and derivatives thereof, organic sulfur compounds, and organic phosphorus compounds. One type of anti-oxidation agent may be used alone and, alternatively, two or more types of such agents may be used in combination. Although there is no particular restriction on the amount of the anti-oxidation agent contained, the content is 0.01 to 10% by weight and preferably 0.05 to 5% by weight of the total amount of component(s) constituting the charge transporting layer. The charge transporting layer may be formed as follows. A charge transporting substance and a binding resin in respective appropriate amounts are dissolved or dispersed in an appropriate organic solvent in which those components can be dissolved or dispersed, an anti-oxidation agent, a plasticizer, and a sensitizer being added as occasion demands, whereby a coating liquid to provide the charge transporting layer is prepared. Then, the coating liquid is applied to a surface of the charge generating layer and dried to form the charge transporting layer. Although there is no particular restriction on the thickness of the charge transporting layer provided as thus described, the thickness is preferably in the range of from 10 to 50 μm and more preferably in the range of from 15 to 40 μm.

A single-layer type photoreceptor having a charge generating substance and a charge transporting substance contained in a single resin layer serving as a photosensitive layer may alternatively be used. In this case, the types and amounts of the charge generating substance and charge transporting substance contained, the type of the binding resin, and the additives may be the same as those in the case in which the charge generating layer and the charge transporting layer are separately formed. Preferably, an underlying layer is provided between the photosensitive layer and the conductive substrate. The provision of the underlying layer is advantageous in that flaws and irregularities on the surface of the conductive substrate can be coated to smooth the surface of the photosensitive layer by providing the underlying layer; any reduction in chargeability of the photosensitive layer attributable to repetitive use can be prevented; the charging characteristics of the photosensitive layer in an environment at a low temperature and/or low humidity can be improved. While the present embodiment employs a photoreceptor drum formed with a photosensitive layer utilizing a charge generating substance and a charge transporting substance as described above, a photoreceptor drum provided by forming an inorganic photosensitive layer containing silicon on a surface of a conductive substrate may alternatively be used.

The charging apparatus 24 has a configuration as shown in FIGS. 2 and 3. The charging apparatus 24 includes a corona electrode 50, a first power supply 65 a support member 51, a shield case 55, a grid electrode 56, and a second power supply 66. The charging apparatus 24 is disposed to face the photoreceptor drum 23 at the electrophotographic process section 21 and to extend along the lengthwise direction of the photoreceptor drum 23.

The corona electrode 50 is a plate-like member including a flat plate section 57 and a pointed projection section 58. Since the corona electrode 50 has the pointed projection section 58 with tips having an acute angle, it forms a non-uniform electric field to cause corona discharge when a voltage is applied from the first power supply 65, and a surface of the photoreceptor drum 23 is charged at a predetermined electric potential having a predetermined polarity. The flat plate section 57 is a plate-like member which extends in the lengthwise direction of the photoreceptor drum 23 at an interval from the photoreceptor drum 23 and which is provided on an imaginary plane including the axis of the photoreceptor drum 23 and extending in the radial direction of the photoreceptor drum 23. The pointed projection section 58 includes a plurality of pointed projections 58*a*. The pointed projections 58*a* are formed to project in the widthwise direction of the flay plate portion 57 from one widthwise end of the flat plate section 57 which faces the photoreceptor drum 23. The projections are spaced in a line at a predetermined pitch TP in the lengthwise direction of the flat plate section 57. In the present embodiment, a length L1 of the flat plate section 57 in the widthwise direction thereof is 10 mm; a length L2 of the pointed projections in the projecting direction thereof is 2 mm; the tips of the pointed projections have a radius of curvature of 40 μm; and the pitch TP of the pointed projections is 2 mm. Although the pointed projections of the present embodiment are in the form of saw teeth as shown in FIG. 2, the technology is not limited to such a shape, and pointed projections having a needle-like shape may alternatively be formed.

Nickel layers containing polytetrafluoroethylene particles (PTFE particles) which are not shown (PTFE-containing nickel layer) are provided on tip parts 58*b* of the pointed projections 58*a* of the corona electrode 50. The PTFE-containing nickel layers are provided on the surface of the tip parts 58*b* of the pointed projections 58*a* using a plating process. At the plating process, for example, a chemical polishing step, a washing step, an acid dipping step, another washing step, a pure water dipping step, a nickel plating step, a PTFE-containing nickel plating step, another washing step, and a drying step are performed in the order listed on a sheet metal to become a corona electrode. A corona electrode 50 to be used in the present technology is thus obtained. Among the listed steps, the nickel plating step is not an essential step, and it is performed as occasion demands.

At the chemical polishing step, the corona electrode sheet metal is masked and etched to form the pointed projection section 58. The masking may be carried out according to a known method. The etching may be also carried out according to a known method. For example, a possible method is to spray an etchant such as an aqueous solution of ferric chloride to the corona electrode sheet metal. The corona electrode metal sheet is preferably a metal sheet made of an iron-type metal such as stainless steel, nickel, and iron. Among those metals, stainless steel is preferred in improving the durability of the corona electrode 50. For example, specific examples of stainless steel include SUS304, SUS309, and SUS316. Among those materials, SUS304 is preferred. Although there is no particular restriction on the thickness of the corona electrode sheet metal, the thickness is preferably in the range of from 0.05 to 1 mm and more preferably in the range of from 0.05 to 0.3 mm. After the pointed projection section 58 is formed at the chemical polishing process, the corona electrode sheet metal is subjected to acid cleaning or pure-water cleaning at the washing step, acid dipping step, the other washing step, and the pure water dipping step to remove foreign substances from the surface of the same, whereby a corona electrode substrate is obtained.

Although the nickel plating step is not an essential step, it is preferable to execute this step to improve adhesion or bondability of a PTFE-containing nickel layer and a gold layer to the corona electrode substrate. While the nickel plating may be carried out using a common process, electroplating is preferably carried out in consideration to the fact that a PTFE-containing nickel layer is to be formed later. An electroplating bath (electroplating solution) of a known type may be used for nickel. For example, a Watt bath, a sulfamate bath, a high-chloride bath, or an all-chloride bath may be used. A Watt bath is primarily composed of, for example, nickel sulfate, nickel chloride, and boric acid. For example, a sulfamate bath is primarily composed of a nickel-based compound such as nickel chloride or nickel bromide and an alkali metal salt of sulfamic acid. Many electroplating baths for nickel are available on the market, and they can be used as they are. There is no particular restriction on nickel plating conditions, the process is performed at a current density in the range of from 1 to 100 A/dm$^2$, a plating bath pH in the range of from 2 to 5, and a plating bath liquid temperature in the range of from 30 to 90° C., and for a plating time in the range of from about 0.1 to 2 hours. Although there is no particular restriction on the thickness of the nickel plating layer, the thickness is preferably in the range of from 0.03 to 3 μm and more preferably in the range of from 0.5 to 1.5 μm. Most preferably, the thickness is about 1 μm.

Figure 4:
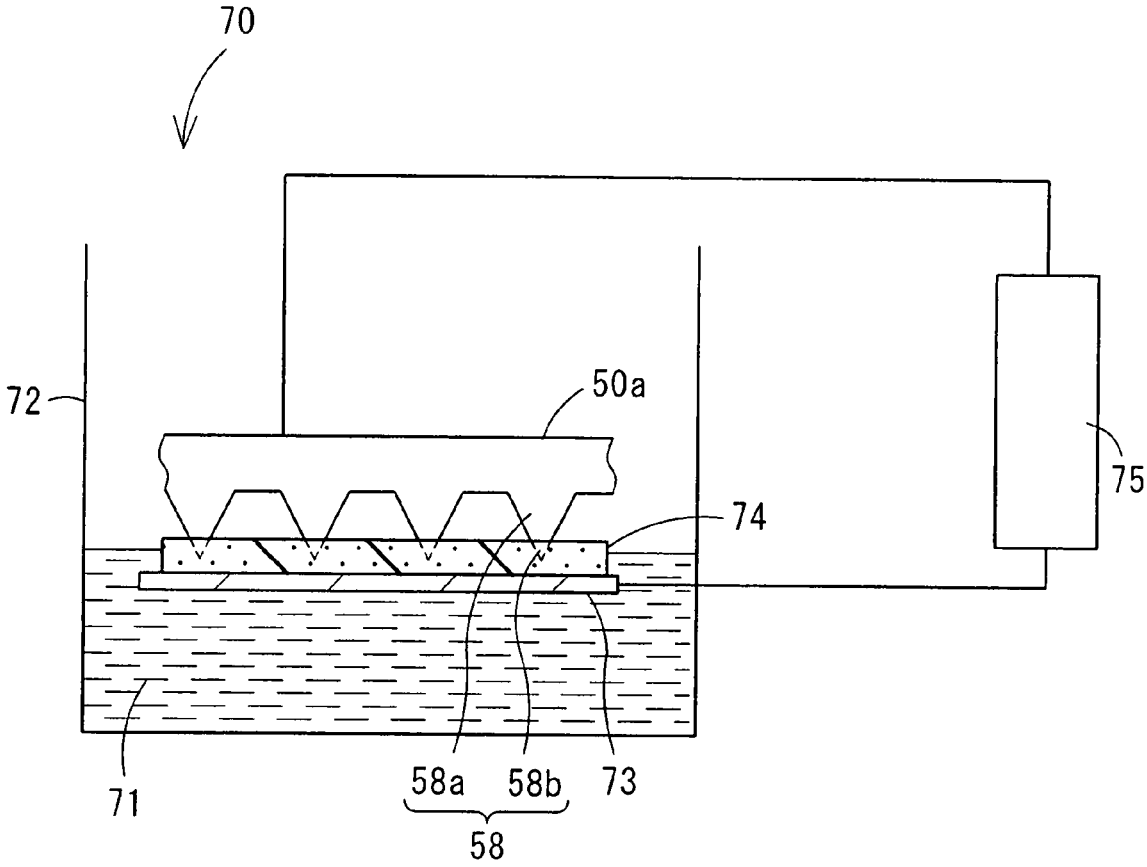
FIG. 4 is a sectional view schematically showing a configuration of the electroplating apparatus.

Nickel plating layers may be formed only on the tip parts 58*b* of the pointed projections 58*a* of the corona electrode substrate 50*a* using an electroplating apparatus 70 as shown in FIG. 4. FIG. 4 is a sectional view schematically showing a configuration of the electroplating apparatus 70. The electroplating apparatus 70 includes a plating bath 72, an electrode 73, a sponge member 74 and a power supply 75. The plating bath 72 is a container-like member having an opening facing upward in the vertical direction, and an electroplating liquid 71 is stored and the electrode 73 and the sponge member 74 are provided in the space inside the bath. The electroplating liquid 71 in the plating bath 72 is heated to an appropriate temperature by a heating section (not shown) provided in the vicinity of the plating bath 72. The electrode 73 is a plate-like electrode provided such that it is immersed in the plating liquid 71 stored in the plating bath 72, and the electrode is supported by a support section which is not shown. The sponge member 74 is provided on a top surface of the electrode 73 in the vertical direction such that part of the member is immersed in the electroplating liquid 71 and such that a top surface of the sponge member 74 itself in the vertical direction is located in a position higher than the level of the electroplating liquid 71 in the vertical direction. The sponge member 74 is uniformly impregnated with the electroplating liquid 71. The power supply 75 is provided outside the plating bath 72, and one end thereof is connected to the electrode 73 and another end thereof is connected to the material to be plated (which is the corona electrode substrate 50*a* in this case) to apply a direct-current voltage between the electrode 73 and the material to be plated.

In the electroplating apparatus 70, the tip parts 58*b* of the pointed projections 58*a* of the corona electrode substrate 50*a* are pressed against the top surface of the sponge member 74 in the vertical direction, and a voltage is applied with the surface of the tip parts 58*b* thus kept in contact with the electroplating liquid 71. As a result, nickel plating layers are selectively formed only on the tip parts 58*b* of the pointed projections 58*a*. At this time, the length of the nickel plating layers from the tops of the tip parts 58*b* can be controlled, for example, by changing the force pressing the corona electrode substrate 50*a* against the sponge member 74 appropriately. The length can be also controlled by changing the composition of the electroplating liquid the temperature of the electroplating bath, and the plating time appropriately. The pointed projections 58*a* of the corona electrode substrate 50*a* and the electrode 71 are disposed opposite to each other, and a voltage is applied between them. A non-uniform electric field attributable to the shape of the pointed projections 58*a* is formed, which contributes to the selective formation of the nickel plating layers.

The PTFE-containing nickel plating step may be performed, for example, the electrolytic nickel plating method. Preferably, the PTFE-containing nickel plating layer is provided at least on part of the pointed projections 58*a*, e.g., on the tip parts 58*b* of the pointed projections 58*a*. When the PTFE-containing nickel layer is provided only on the tip parts 58*b*, the surface area required to provide the layer can be made equal to or smaller than one-third that required when the PTFE-containing nickel layer is provided on the entire surface of the pointed projections 58*a*. Therefore, the manufacturing cost of the corona electrode 50 can be made lower, and the smaller surface area improves the adhesion of the PTFE-containing nickel plating layer to the surface of the pointed projections 58*a* contrary to expectations and makes the layer less vulnerable to corona discharge, ozone, and moisture in the air. As a result, the life of the PTFE-containing nickel layer is extended, and there will be smaller reduction in the function of protecting the corona electrode 50. Even when the PTFE-containing nickel layer has a partial void attributable to non-uniform dispersion of PTFE particles, there is little possibility that the void will adversely affect the neighborhood thereof to spread further. Thus, even if there is a partial void, the function of protecting the corona electrode 50 provided by the PTFE-containing layer as a whole will not be reduced so much, and the function can therefore be maintained at a high level for a long period.

The electroplating liquid used is a plating liquid which is obtained by adding PTFE particles in a plating liquid similar to that used in the above-described nickel plating step. Although there is no particular restriction on the diameter of the PTFE particles other than that it should be smaller than the thickness of the plating layer, the particles preferably have a volume average particle diameter of 1 μm or less, and the volume average particle diameter is more preferably in the range of from 100 to 500 nm. A volume average particle diameter is a value obtained by a method as described below. A sample for measurement was prepared by adding 20 mg of sample and 1 ml of sodium alkylether sulfate to 50 ml of an electrolytic solution (product designation: ISOTON-II manufactured by Beckman Coulter, Inc.) and dispersing them for three minutes at an ultrasonic frequency of 20 kz using an ultrasonic disperser (product designation: UH-50 manufactured by STM Corp.). The measurement sample was measured by counting 50,000 particles at an aperture diameter of 100 μm using by a particle size distribution measuring apparatus (product designation: Multisizer2 manufactured by Beckman Coulter, Inc.) to obtain a volume average particle diameter from a volumetric particle size distribution of the sample particles. Although there is no particular restriction on the amount of PTFE particles added in the plating liquid, the amount is preferably in the range of from 0.01 to 10% by weight and more preferably in the range of from 0.1 to 1.0% by weight of the total amount of the plating liquid. The PTFE-containing nickel layer is formed by carrying out electroplating using the plating bath and the electroplating apparatus 70 shown in FIG. 4. The plating conditions may be the same as those for electro nickel plating. The thickness of the PTFE-containing nickel layer may be controlled by appropriately selecting plating conditions, in particular, plating time.

When the PTFE-containing nickel layers are provided only on the tip parts 58*b* of the pointed projections 58*a*, the length of the layers from the tops of the tip parts 58*b* is preferably in the range of from 0.3 to 20 μm, more preferably in the range of from 1 to 15 μm, and most preferably in the range of from 5 to 10 μm. The length from the tops of the tip parts 58*b* is the length of imaginary lines extending vertically upward from the tops of the tip parts 58*b* of the pointed projections 58*a* up to the upper peripheries of the plating layers measured with the corona electrode 50 disposed such that the flat plate section 57 of the corona electrode 50 extends parallel to the horizontal direction and such that the pointed projection portion 58 faces downward in the vertical direction.

The amount of PTFE contained in the PTFE-containing nickel layers thus formed is preferably in the range of from 3 to 30% by volume and more preferably in the range of from 20 to 30% by volume. Although there is no particular restriction on the thickness of the PTFE-containing nickel layers thus formed, the thickness is preferably 0.3 μm or more, more preferably in the range of from 0.3 to 20 μm, and most preferably in the range of from 1 to 10 μm. When the thickness is less than 0.3 μm, the smoothness of the surface of the plating layers is insufficient, and any foreign substance deposited on the surface will not leave the surface easily. Further, the layers will be more liable to the generation of pin holes which will reduce the uniformity of the layers. The corona electrode substrate 50*a* can be corroded through the pin holes, and the potential at which the photoreceptor drum 23 is charged can therefore become liable to partial instability. When the thickness is significantly greater than 20 μm, the plating films can come off because of stress. Thus, a corona electrode 50 is obtained with the PTFE-containing nickel plating layers formed as thus described. In the present embodiment, a voltage of 5 kV is applied to the corona electrode 50. As a result, corona discharge occurs at the tip parts 58*b* of the pointed projections 58*a* toward the surface of the photoreceptor drum 23 to charge the surface of the photoreceptor drum 23 at a predetermined electrical potential having a predetermined polarity.

In the present embodiment, a gold plating step may be performed instead of the PTFE-containing nickel plating step. The gold plating step also employs a common electro gold plating bath and the electroplating apparatus 70 as shown in FIG. 4 to perform electroplating under common plating conditions for gold plating, whereby a gold plating layer having a desired thickness can be formed. One exemplary method of gold plating includes a degreasing step, an acid cleaning step, a strike nickel plating step, a nickel plating step, a gold plating step, a washing step, and a drying step. At the degreasing step, a processing oil and the like deposited on the surface of an object to be plated are removed. At the acid cleaning step, the surface of the object to be plated is cleaned and activated with an acid. At the strike nickel plating step, a thin nickel plating layer is formed on the surface of the object to be plated which has been cleaned with an acid. In this case, either chemical plating or electroplating may be performed. The strike nickel plating step may be omitted. At the nickel plating step, electro nickel plating is performed. Electro gold plating is performed at the gold plating step. For example, electro gold plating baths include cyan gold plating baths and cyan-free gold plating baths. Known cyan gold plating baths may be used, for example, including gold plating baths containing gold potassium cyanide, potassium cyanide, and dipotassium hydrogenphosphate may be used. Known cyan-free gold plating baths may be used, for example, including cyan-free gold plating baths containing gold(III) sodium chloride and potassium ferrocyanide at a pH value of 6, a bath temperature of 60° C., and a current density of 0.5 A/dm$^2$, soft gold baths containing gold and potassium phosphate at a pH value of 5.8, a bath temperature of 70° C., and a current density of 0.3 A/dm$^2$, cyan-free gold plating baths containing one type of or two or more types of cyan-free gold compounds selected from among an acetylcysteine gold complex, a cysteine gold complex, a mercaptosuccinic acid gold complex, a gold chloride complex, and an alkali metal salt and/or a ammonium salt of a gold sulfite complex and containing acetylcysteine (complexing agent), and cyan-free gold plating baths containing a gold hydroxide, 1,2-ethanediamine hydrochloride, a boric acid, and 2,2-bipyridyl and having a pH value of 3.8. Although there is no particular restriction on the thickness of the gold plating layer, the thickness is preferably in the range of from 0.3 to 3 μm, more preferably in the range of from 0.5 to 1.5 μm, and most preferably about 1 μm. At the washing step, the gold plating layer provided on the surface of the object to be plated is washed with water. At the drying step, moisture on the surface of the gold plating layer is removed using hot air. Thus, a corona electrode 50 formed with a gold plating layer is obtained.

The first power supply 65 is controlled to apply a predetermined voltage to the corona electrode 50 by a control unit (not shown) provided in the image forming apparatus 1. In the present embodiment, the first power supply 65 applies a voltage of about 4 to 5 kV to the corona electrode 50. As a result, a constant current in the range of from 400 to 800 μA flows through the pointed projection portion 58 of the corona electrode 50.

The support member 51 is a member which extends in the lengthwise direction of the photoreceptor drum 23 similarly to the corona electrode 50 and which has a T-shaped section when viewed in a direction perpendicular to the lengthwise direction. Both lengthwise ends of the flat plate section 57 of the corona electrode 50 are screwed to both lengthwise ends of one side surface of a projecting portion of the support member 51 with screw members 59. Thus, the support member 51 supports the corona electrode 50. For example, the support member 51 is formed of a synthetic resin. The shield case 55 is a rectangular container-like member extending in the lengthwise direction of the photoreceptor drum 23 and having an opening facing the surface of the photoreceptor drum 23. The corona electrode 50 and the support member 51 are contained in the space inside the case. The support member 51 is mounted on a bottom surface 63 of the shield case 55.

The grid electrode 56 is a member in the form of a thin plate which is provided between the corona electrode 50 and the photoreceptor drum 23 and to which a voltage is applied from the second power supply 66 to adjust variation of the state of charging of the surface of the photoreceptor drum 23, whereby the charging potential is made more uniform. The grid electrode 56 is a member in the form of a porous thin plate having a plurality of through holes, which are not shown, formed to penetrate through the plate in the thickness direction. The grid electrode 56 is disposed such that the lengthwise direction of the same is in parallel with the lengthwise direction of the photoreceptor drum 23.

Figure 7:
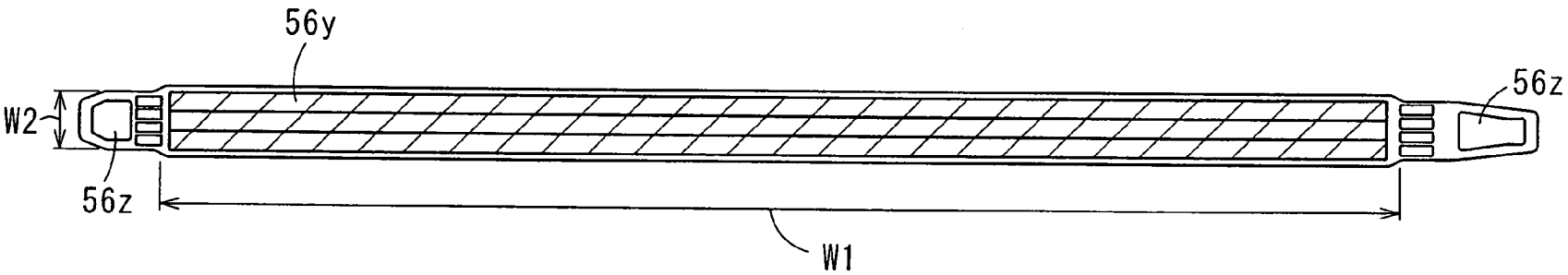
FIG. 7 is a plan view schematically showing a configuration the grid electrode.

FIG. 7 is a plan view schematically showing a configuration the grid electrode 56. The grid electrode 56 includes an opening part 56*y* and fitting holes 56*z*. The opening part 56*y* includes a plurality of through holes which are formed to extend in parallel with each other at a predetermined pitch. The fitting holes 56*z* are formed on both ends of the grid electrode 56 in the lengthwise direction thereof. By fitting the support member, which is not shown, provided in the space in the shield case 55, in the two fitting holes 56*z*, the grid electrode 56 is detachably supported by the shield case 55. The grid electrode 56 can be manufactured according to a known method. For example, the grid electrode 56 may be manufactured by processing a sheet metal to serve as the grid electrode using a manufacturing method including a chemical polishing step, a washing step, an acid dipping step, another washing step, and a pure water dipping step. The sheet metal to serve as the grid electrode is made of a metal material such as stainless steel, aluminum, nickel, copper or iron. The chemical polishing step involves masking and etching to form the multiplicity of through holes in the thickness direction of the sheet metal to serve as the grid electrode. The grid electrode 56 may be plated with nickel, PTFE-containing nickel, and gold just as done for the corona electrode 50 as occasion demands.

The second power supply 66 is controlled by the control unit (not shown) provided in the image forming apparatus 1 such that it applies a predetermined voltage to the grid electrode 56. In the present embodiment, the second power supply 66 applies a voltage in the range of from 550 to 600 V to the grid electrode 56.

The charging apparatus 24 causes corona discharge to charge the surface of the photoreceptor drum 23 when a voltage is applied to the corona electrode 50. The charging state of the surface of the photoreceptor drum 23 is made uniform by applying a predetermined grid voltage to the grid electrode 56. Thus, the surface of the photoreceptor drum 23 can be charged at a predetermined electrical potential having a predetermined polarity.

The light-scanning unit 25 includes a laser light source 25*a*, a polygon mirror 25*b*, a lens 25*c*, and mirrors 25*d* and 25*e*. The laser light source 25*a* emits signal light that is laser light modulated according to image information inputted from the original reading portion 5 or an external apparatus. For example, a semiconductor laser may be used as the laser light source 25*a*. The polygon mirror 25*b* deflects the laser light emitted from the laser light source 25*a* into a main scanning direction. The lend 25*c* converges the laser light deflected by the polygon mirror 25*b* and traveling in the main scanning direction such that it forms an image on the surface of the photoreceptor drum 23. The mirrors 25*d* and 25*e* reflect the laser light converged by the lens 25*c* to irradiate the surface of the photoreceptor drum 23 which is charged at a predetermined electrical potential having a predetermined polarity. As a result, an electrostatic latent image is formed on the surface of the photoreceptor drum 23. The laser light emitted from the laser light source 25*a* of the light-scanning unit 25 is deflected by the polygon mirror 25*b*, converged by the lens 25*c*, and reflected by the mirrors 25*d* and 25*e* toward the surface of the photoreceptor drum 23 to form an electrostatic latent image on the same.

The developing unit 26 includes the developing roller 26*a*, a supply roller 26*b*, and a casing 26*c*. The developing roller 26*a* is a roller member provided such that it is pressed against the surface of the photoreceptor drum 23 and such that it can be rotated by a driving mechanism which is not shown. The region where the developing roller 26*a* is pressed against the photoreceptor drum 23 constitutes a developing nip portion. In the developing nip portion, the developing roller 26*a* supplies toner to the electrostatic latent image on the surface of the photoreceptor drum 23 to form a toner image. A developing bias voltage may be applied to the developing roller 26*a*. The supply roller 26*b* is a roller member provided such that it is pressed against the developing roller 26*a* and such that it can be rotated by a driving mechanism which is not shown. The roller supplies a developer including toner to the developing roller 26*a*. The casing 26*c* is a container-like member having a space therein. The developer is stored in the internal space, and the developing roller 26*a* and the supply roller 26*b* are rotatably supported by the casing. The developer stored in the casing 26*c* of the developing unit 26 is deposited on the surface of the developing roller 26*a* when the supply roller 26*b* is rotated, and the developer is supplied from the surface of the developing roller 26*a* to the electrostatic latent image on the surface of the photoreceptor drum 23 at the developing nip portion. Thus, the electrostatic latent image is developed into a toner image.

The transfer unit 28 includes a driving roller 28*a*, driven rollers 28*b* and 28*c*, and an endless bent 28*d*. The driving roller 28*a* is a roller member provided such that it is pressed against the surface of the photoreceptor drum 23 with the endless belt 28*d* interposed between them and such that it can be rotated about an axis by a driving mechanism which is not shown. The region where the driving roller 28*a* is pressed against the photoreceptor drum 23 constitutes a transfer nip portion. When the driving roller 28*a* is rotated, the endless belt 28*d* and the driven rollers 28*b* and 28*c* are rotated accordingly. A transfer bias voltage may be applied to the driving roller 28*a*. The driven rollers 28*b* and 28*c* are roller members which are rotatably supported by a support section (not shown) and which are rotated according to the rotation of the driving roller 28*a*. The driven rollers 28*b* and 28*c* impart an appropriate tension to the endless belt 28*d* such that the endless belt 28*d* is smoothly rotated. The endless belt 28*d* is a member which is stretched around the driving roller 28*a* and the driven rollers 28*b* and 28*c* to form a moving path in the form of a loop, and the belt is rotated as the driving roller 28*a* is rotated. When the endless belt 28*d* is rotated, the recording medium having a toner image transferred thereto at the transfer nip portion is conveyed toward the fixing section 22. In the transfer unit 28, the recording medium is fed from the sheet feeding portion 2 to the transfer nip portion through a third conveying path 33, and the recording medium is pressed by the driving roller 28*a* into contact with the surface of the photoreceptor drum 23 to transfer the toner image on the surface onto the recording medium. The recording medium having the toner image thus transferred is sent to the fixing portion 22.

The cleaning unit 29 removes any residual toner on the surface of the photoreceptor drum 23 after the toner image is transferred onto the recording medium at the transfer unit 28 to clean the surface of the photoreceptor drum 23. For example, a cleaning unit including a cleaning roller and a toner container may be used as the cleaning unit 29. The cleaning roller is a roller member provided to be pressed against the photoreceptor drum 23, and the roller removes toner and paper dust remaining on the surface of the photoreceptor drum 23. The toner and paper dust removed from the surface of the photoreceptor drum 23 by the cleaning roller are temporarily stored in the toner container. A cleaning blade may be used instead of the cleaning roller. The cleaning blade is provided such that it extends in the lengthwise direction of the photoreceptor drum 23 and such that one widthwise end of the same is put into contact with the surface of the photoreceptor drum 23. In the image forming apparatus 1 of the present embodiment, an organic photoreceptor drum is primarily used as the photoreceptor drum 23, and the surface of the organic photoreceptor drum is primarily made of resin components. Therefore, the surface is liable to deterioration attributable to chemical effects of ozone generated by corona discharge caused by the charging apparatus. However, deteriorated parts of the surface are abraded by the rubbing effect of the cleaning unit 29 and are surely removed, although the removal proceeds slowly. Therefore, the problem of surface deterioration attributable to ozone is substantially solved, and the charging potential provided by the charging operation can be stably maintained for a long period.

As the photoreceptor drum 23 is rotated, the electrophotographic process section 21 performs a series of operations, i.e., the formation of an electrostatic latent image through charging and exposure, the formation of a toner image through the development of the electrostatic latent image, the transfer of the toner image onto the recording medium, and the cleaning of the surface of the photoreceptor drum 23. Thus, the toner image is transferred onto the recording medium, and the recording medium is fed to the fixing portion 22.

The fixing portion 22 includes a fixing roller 30, a pressure roller 31, and a temperature sensor 32, and the portion fixes the toner image transferred onto the recording medium at the electrophotographic process section 21 on the recording medium. The fixing roller 30 is a roller member which is provided such that it can be rotated about an axis by a driving mechanism (not shown) and which incorporates a heating section (not shown) therein. An infrared heater or a halogen lamp may be used as the heating section. The pressure roller 31 is a roller member which is provided such that it is pressed against the surface of the fixing roller 30 and such that it is rotatably supported about an axis to be rotated as the fixing roller 30 is rotated. The region where the fixing roller 30 and the pressure roller 31 are pressed against each other constitutes a fixing nip portion. The temperature sensor 32 is provided in the vicinity of the surface of the fixing roller 30 to detect the temperature of the surface of the fixing roller 30. The amount of electric power supplied to the heater is controlled by a control section which is not shown to keep the surface temperature of the fixing roller 30 at a predetermined value according to the result of detection by the temperature sensor 32. In the fixing portion 22, the recording medium having a toner image obtained at the electrophotographic process section 21 is fed to the fixing nip portion, and the medium is pressed and heated while being passed through the fixing nip portion as the fixing roller 30 and the pressure roller 31 are rotated. As a result, the toner image is fixed on the recording medium. A recording medium having an image recorded thereon is thus obtained.

In the image forming portion 3, the toner image according to image information is transferred onto the recording medium fed from the sheet feeding portion 2, and the toner image is then heated and pressed to fix it on the recording medium. Thus, recording media having images of high quality formed thereon can be continuously obtained for a long period.

The sheet discharge portion 4 includes a fourth conveying path 34, a fifth conveying path 35, reversing rollers 36*a* and 36*b*, a sixth conveying path 37, a sheet discharge tray which is not shown, and a switching gate which is not shown. The fourth conveying path 34 allows the recording medium having an image recorded thereon obtained at the fixing portion 22 of the image forming portion 3 to be fed to the reversing rollers 36*a* and 36*b*. The fifth conveying path 35 allows the recording medium having an image recorded thereon to be conveyed to the sheet discharge tray or the sixth conveying path 37. The reversing rollers 36*a* and 36*b* are provided such that both of them can be rotated in forward and reverse directions about an axis and such that they are pressed against each other, which allows the conveying direction of the recording medium having an image recorded thereon to be changed. When the recording medium having an image recorded thereon is supplied to the region where the reversing rollers 36*a* and 36*b* are pressed against each other through the fourth conveying path 34, an end of the medium is sandwiched between the reversing rollers 36*a* and 36*b* as a result of the rotation of the reversing rollers 36*a* and 36*b* in the forward direction. Thereafter, the medium is conveyed in the fifth conveying path 35 by the rotation of the reversing rollers 36*a* and 36*b* in the reverse direction. The sixth conveying path 37 is provided in connection with the third conveying path 33 to convey the recording medium having an image recorded one side thereof back into the third conveying path 33. The sheet discharge tray is provided outside the image forming apparatus 1. The switching gate switches the conveying direction of the recording medium having an image recorded thereon fed back through the fifth conveying path 35 to the direction indicated by the arrow 101 or the direction toward the sixth conveying path 37. In the sheet discharge portion 4, when an image is to be recorded on one side of the recording medium only, the medium is switched to the direction indicated by the arrow 101 by an operation of the switching gate, which is not shown, to be discharged via the fifth conveying path 35 onto the sheet discharge tray which is not shown, located outside the image forming apparatus 1. When an image is to be formed on both sides of the recording medium, the medium is conveyed from the fifth conveying path 35 to the sixth conveying path 37 by an operation of the switching gate which is not shown. The medium is reversed upside down and is thereafter conveyed through the third conveying path to the image forming portion 3 where a toner image is transferred and fixed.

The original reading portion 5 includes an original feeding part 38 and an image reading part 39. The original feeding part 38 includes an original tray 40, an original guide plate 41, a curved conveying path 42, a protective mat 43, and a discharge roller 49. Original documents are placed in the original tray 40 such that surfaces of the originals having images thereon face upward. The original guide plate 41 feeds the originals into the curved conveying path 42 one sheet at a time. The original is conveyed through the curved conveying path 42 to a position directly above an original table 45, which will be described later, while being reversed such that the surface having an image faces downward. The protective mat 43 is provided on a surface where the original feeding part 38 and the original table 45 contact each other to protect the original table 45 which is primarily constituted by a platen glass. After the image information on the original is read by the image reading part 39 at the original table 45, the discharge roller 49 discharges the original on to a discharge tray, which is not shown, provided outside the image forming apparatus 1. In the original feeding part 38, original documents are placed in the original tray 40 with surfaces of the originals having images facing vertically upward. Condition input keys of an operation panel, which is not shown, disposed on the front side of the exterior of the image forming apparatus 1 are operated to input printing conditions such as a number of sheets to be printed, a magnification for printing, and a sheet size, and a start key is then pressed to start a copying operation. The originals placed in the original tray 40 are automatically conveyed one sheet at a time, and the sheet is reversed while being conveyed such that the surface having an image faces downward and conveyed to a position directly above the original table 45. While the original is passing over the original table 45, the image information on the original is read by the original reading part 39. Thereafter, the original is discharged onto the discharge tray, which is not shown, located outside the image forming apparatus 1 by the discharge roller 49.

The image reading part 39 includes an original table 44, the original table 45, a light source unit 46, a mirror unit 47, and a CCD reading unit 48. The original table 44 is constituted by, for example, a platen glass, and it is provided to read image information on an original placed thereon which cannot be automatically conveyed. The original table 45 is constituted by, for example, a platen glass, and it is provided at an interval from the original table 44 when viewed in the sub scanning direction. The original table 45 is provided to read image information on an original which can be automatically conveyed from the original tray 40 when the original passes over the table. The light source unit 46 includes a light source 46*a*, a reflector which is not shown, a slit which is not shown, and a mirror 46*b*. The light source 46*a* is provided such that it can be moved in a direction (sub scanning direction) parallel to surfaces of the original tables 44 and 45, and it emits illumination light for reading toward an original. The reflector is a concave reflector for converging the illumination light for reading emitted from the light source 46*a* to a predetermined reading position on the original table 44 or the original table 45. The slit selectively allows only reflected light from an original to pass. The mirror 46*b* reflects the reflected light from the original at 90°. The light source unit 46 radiates illumination light for reading toward the original and supplies light reflected from the original to the mirror unit 47. The mirror unit 47 includes a pair of mirrors 47*a* and 47*b*. The pair of mirrors 47*a* and 47*b* is disposed such that their reflecting surfaces are orthogonal to each other. The mirrors change the optical path of the reflected light from the original supplied by the light source unit 46 at an angle of 180° to guide the light to the CCD reading unit 48. The CCD reading unit 48 includes an image-forming lens 48*a* and a CCD image sensor 48*b* and converts the reflected light from the original into an electrical signal. The image-forming lens 48*a* forms an image of the reflected light from the mirror unit 47. The CCD image sensor 48*b* outputs an electrical signal according to the light imaged by the image-forming lens 48*a*. In the CCD reading unit 48, an image of the reflected light entering the image-forming lens 48*a* from the mirror unit 47 is formed, and the image is converted into an electrical signal by the CCD image sensor 48*b*. The image information in the form of an electrical signal is inputted to the light-scanning unit 25 through a control section which is not shown, and image formation is performed according to the information.

In the image reading part 39, image information on an original placed on the original table 44 or 45 is acquired as reflected light from the original by irradiating the original with light from the light source unit 46. The reflected light is guided to the CCD reading unit 48 through the mirror unit 47 to be converted into image information in the form of an electrical signal. The information is subjected to image processing under preset conditions and is then transmitted to the light-scanning unit 25 of the image forming portion 3 to form an image from the same.

A control unit, which is not shown, is provided in an upper part of the space inside the image forming apparatus 1. The control unit includes a storage portion, a calculation portion, and a control portion. Various types of information and programs for executing control activities in the image forming apparatus 1 are inputted to the storage portion. Inputs to the storage portion further include various values set through a display section, which is not shown, disposed on the top surface of the image forming apparatus 1 in the vertical direction, results of detection from sensors, which are not shown, disposed in various positions in the image forming apparatus 1, and image information included in print commands from an external apparatus. A storage that is normally used in the field may be used as the storage portion. For example, a read only memory (ROM), a random access memory (RAM), or a hard disk drive (HDD) may be used. The calculation portion fetches the various types of data (print commands, detection results, and image information) inputted to the storage portion and programs for various portions of the apparatus to make various types of determination. The control portion sends control signals to relevant portions of the apparatus according to results of determination at the calculation portion to control their operations. The control portion and the calculation portion are processing circuits which are constituted by, for example, microcomputers or microprocessors having a central processing unit (CPU). The control unit includes a main power supply in addition to the storage portion, the calculation portion, and the control portion.

The image forming apparatus 1 includes the charging apparatus 24 having the corona electrode 50 which exhibits high durability against ozone and moisture in the air, which can charge the surface of a photoreceptor drum 23 uniformly and stably throughout the life of the image forming apparatus 1, and which can be manufactured at a low cost. Thus, images having a certain high level of quality can be stably formed for a long period.

Figure 5:
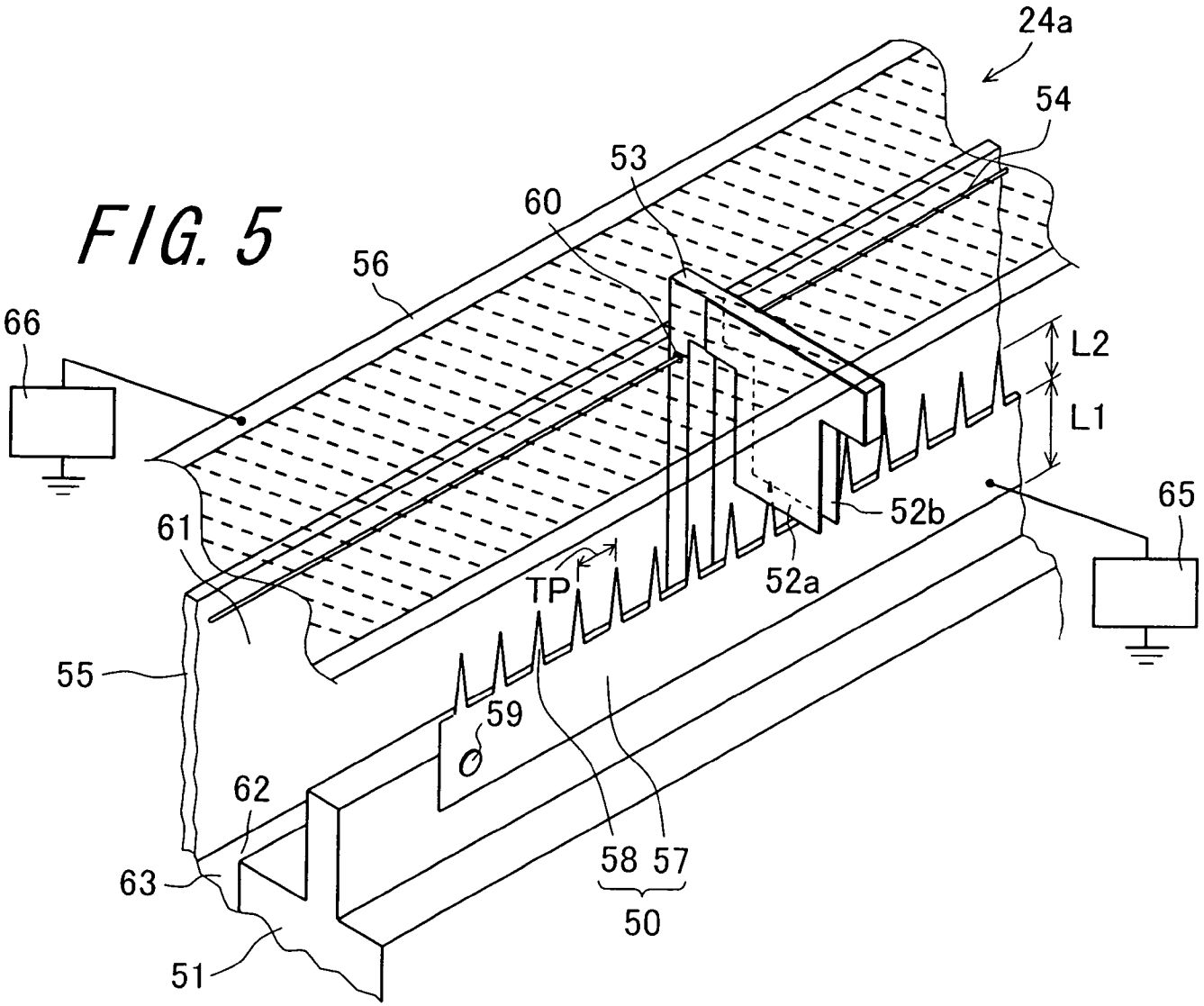
FIG. 5 is a perspective view schematically showing a configuration of the charging apparatus according to still another embodiment.
Figure 6:
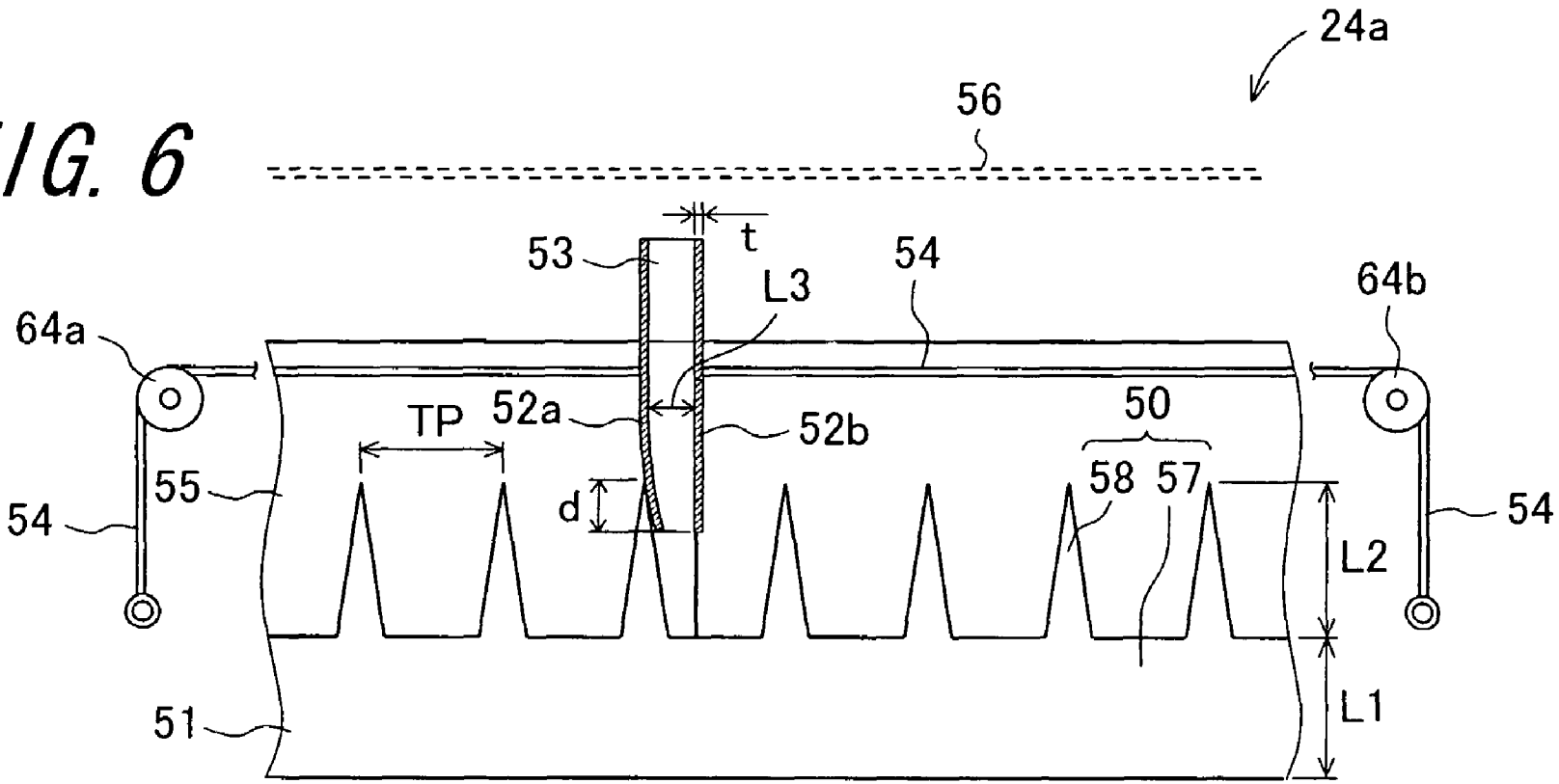
FIG. 6 is a front view of the charging apparatus in FIG. 5 showing a configuration of major parts of the same.

Although the present embodiment employs the charging apparatus 24, the technology is not limited to the same. For example, a charging apparatus 24*a* as shown in FIGS. 5 and 6 may alternatively be used. FIG. 5 is a perspective view schematically showing a configuration of the charging apparatus 24*a* according to still another embodiment. FIG. 6 is a front view of the charging apparatus 24*a* in FIG. 5 showing a configuration of major parts of the same. The charging apparatus 24*a* is similar to the charging apparatus 24, and parts in mutual correspondence between those apparatus are indicated by like reference numerals will not be described below. The charging apparatus 24*a* includes cleaning members 52*a* and 52*b*, a holding member 53, and a moving member 54 in addition to a corona electrode 50, a support member 51, a shield case 55, and a grid electrode 56. The corona electrode 50, the support member 51, the shield case 55, and the grid electrode 56 are similar in configuration to those in the charging apparatus 24. The cleaning members 52*a* and 52*b*, the holding member 53, and the moving member 54 are provided for cleaning the corona electrode 50.

The cleaning members 52*a* and 52*b* are plate-like members which are T-shaped in a projected plan view of the same. Those members are provided such that they can be moved relative to the corona electrode 50, and they rub the corona electrode 50 during the movement to clean the surface of the corona electrode 50. For example, the cleaning members 52*a* and 52*b* is constituted by elastic bodies made of a metal material or a polymeric material. A metal material is preferred. For example, phosphor bronze, common steel, or stainless steel may be used as the metal material. Among those metals, stainless steel is preferable in terms of durability which is to be discussed based on anti-oxidation properties when consideration is paid to the fact that the cleaning members 52*a* and 52*b* are used in an ozone atmosphere generated by corona discharge. Known stainless steels may be used, for example, including SUS304 that is austenitic stainless steel according to the specification in Japan Industrial Standard (JIS) G4305 and SUS430 that is ferritic stainless steel. The cleaning members 52*a* and 52*b* have a thickness t in the range of from 20 to 40 μm. When the thickness t is smaller than 20 μm, although the members will be easily deformed when put in contact with the corona electrode 50, they may be unable to remove foreign substances deposited on the corona electrode 50 sufficiently because the pressing force applied to the corona electrode 50 that is a reaction force against the deformation is small. When the thickness t is in the excess of 40 μm, although foreign substances deposited on the corona electrode 50 can be sufficiently removed, the members become too rigid and apply an excessively high pressing force to the corona electrode 50. As a result, the tip parts 58*b* of the pointed projections 58*a* of the corona electrode 50 can be deformed and damaged. When the thickness t is out of the range of from 20 to 40 μm, images may have irregularities attributable to a charging failure. Therefore, the cleaning members 52*a* and 52*b* are constituted by the above factors.

The hardness of the cleaning members 52*a* and 52*b* is preferably 115 or more and more preferably in the range of from 115 to 130 when Rockwell M hardness scale is used according to American Society for Testing and Materials (ASTM) specification D785. In the case of Rockwell hardness less than 115, the members are too soft and are deformed more than required when they are put in contact with the corona electrode 50 to rub the same. Therefore, since the cleaning members 52*a* and 52*b* are too deformed, the cleaning effect cannot be achieved sufficiently. Rockwell hardness 130 is the present upper limit of the ASTM specification D785, and ASTM specification D785 has no mention of hardness higher than that. The cleaning members 52*a* and 52*b* may have hardness higher than Rockwell hardness 130.

Let us assume that w represents the width of the vertical parts of the T-shaped cleaning members 52*a* and 52*b* which are put in contact with the corona electrode 50 or the width of the cleaning members 52*a* and 52*b* in a direction perpendicular to the moving direction of the cleaning members 52*a* and 52*b* and perpendicular to the extending direction of the pointed projection section 58. Then, the dimension w is preferably 3.5 mm or more, and more preferably in the range of from 3.5 mm to 10 mm. When the width dimension w is smaller than 3.5 mm, the force acting on the members when they are pressed and deformed by the corona electrode 50 has a great value per unit area, which reduces the life of the members because they are more liable to fatigue failure attributable to repeated deformation. When the dimension W is 3.5 mm or more, the force mentioned above has a smaller value per unit area, and the durability of the members against repeated deformation can be improved. However, when the width is too great, the cleaning members will have excessively high rigidity, and the size of the apparatus will be increased. It is therefore desirable to set an upper limit of about 10 mm.

It is preferable to dispose the cleaning members 52*a* and 52*b* and the corona electrode 50 such that an overlapping amount d of the pointed projection section 58 of the corona electrode 50 with respect to the cleaning members 52*a* and 52*b* falls in the range of from 0.2 to 0.8 mm. The overlapping amount d means the length of an overlap between the cleaning members 52*a*, 52*b* and the pointed projection section 58 of the corona electrode 50 in the extending direction of the pointed projection section 58, the overlap being measured on an image of the cleaning members 52*a*, 52*b* and the pointed projection section 58 projected on an imaginary plane perpendicular to the direction in which the cleaning members 52*a* and 52*b* are moved relative to the corona electrode 50. When the overlapping amount d is smaller than 0.2 mm, since the force pressing the corona electrode 50 that is reaction force attributable to the deformation of the cleaning members 52*a* and 52*b* is too small, foreign substances deposited on the corona electrode 50 cannot be sufficiently removed. When the overlapping amount d is in the excess of 0.8 mm, the tips of the pointed projection section 58 of the corona electrode 50 can be deformed and damaged because the reaction force attributable to the deformation of the cleaning members 52*a* and 52*b* (the force pressing the corona electrode 50) is excessively great, although foreign substances deposited on the corona electrode 50 can be sufficiently removed. In conclusion, when the overlapping amount d is out of the range of from 0.2 to 0.8 mm, images may have irregularities attributable to charging failures.

The holding member 53 is a member in the form of an inverted L for supporting the cleaning members 52*a* and 52*b*. Arm portions of the T-shaped cleaning members 52*a* and 52*b* are attached to a beam-like portion of the member 53. The two cleaning members 52*a* and 52*b* are provided at a predetermined interval L3 in the direction of their movement relative to the corona electrode 50. The interval L3 is a distance chosen to prevent one of the cleaning members (e.g., the cleaning member 52*a*) from being interfered by the other cleaning member or the cleaning member 52*b* when the cleaning member 52*a* is deformed as a result of contact with the corona electrode 50. The interval can be adjusted by the thickness of the beam-like portion of the holding member 53 to which the cleaning members are attached. Since the cleaning members 52*a* and 52*b* are deformed differently depending on the material of which the members are formed, it is desirable to set the interval L3 by testing the deformation of the material in advance. For example, when the cleaning members 52*a* and 52*b* are constituted by stainless steel having a thickness t of 30 μm, the interval L3 is preferably 2 mm. By providing the interval L3 between the two cleaning members 52*a* and 52*b*, one of the cleaning members (e.g., cleaning member 52*a*) can keep applying a pressing force in a preferable range in rubbing the corona electrode 50 without hindrance to its deformation by the other cleaning member 52*b*. Thus, the tips of the corona electrode 50 can be sufficiently cleaned without deforming and damaging them.

The pressing force applied by the cleaning members 52*a* and 52*b* to the corona electrode 50 is preferably in the range of from 10 to 30 gf. When the pressing force is smaller than 10 gf, foreign substances such as toner and paper dust deposited on the corona electrode 50 may not be sufficiently removed. When the pressing force is in the excess of 30 gf, the tips of the pointed projection section 58 of the corona electrode 50 can be deformed and damaged. For example, the pressing force applied by the cleaning members 52*a* and 52*b* to the corona electrode 50 can be adjusted as follows. A weight is hung on one end of a moving member 54 which will be described later, and the magnitude of a force acting on the cleaning member 52*a* or 52*b* in this state is measured. For example, the measurement is carried out by connecting a spring balance to the cleaning member 52*a* or 52*b*. A weight which applies a force in the range of from 10 to 30 gf to the cleaning member 52*a* or 52*b* is chosen. The weight chosen in advance is hung on the end of the moving member 54 when the corona electrode 50 is cleaned, which allows the electrode to be cleaned with a predetermined pressing force. Alternatively, an electric motor having adjusted torque may be connected to the end of the moving member 54 to load a predetermined pressing force.

The holding member 53 is a member having a post portion and a support portion for supporting the cleaning members 52*a* and 52*b*. The post portion extends in the vertical direction, and the bottom end thereof in the vertical direction is slidably inserted in a groove 62 formed by inner sidewalls 61 of the shield case 55 and the support member 51. The post portion is formed with a through hole 60 which extends through the shield case 55 in the lengthwise direction thereof. The support portion is provided to extend in the horizontal direction vertically above the corona electrode 50 from the top end of the post portion in the vertical direction. The cleaning members 52*a* and 52*b* are mounted on both side surfaces, which are not shown, of the support portion in the lengthwise direction of the shield case 55. Thus, the cleaning members 52*a* and 52*b* are supported.

The moving member 54 is provided to be inserted in the through hole 60 formed in the post portion of the holding member 53 and to horizontally extend in the lengthwise direction of the shield case 55, and the member is secured to the holding member 53 by the through hole 60. Further, the moving member 54 extends out of the shield case 55 through holes or gaps formed on the shield case 55, and the ends of the member are wound around pulleys 64*a* and 64*b* provided on outer surfaces of the shield case 55 or the body of the image forming apparatus 1 to extend downward. The illustration in FIG. 5 omits the pulleys 64*a* and 64*b* and the ends of the moving member 54. The ends of the moving member 54 preferably extend out of the body of the image forming apparatus 1. In such a configuration, when the ends of the moving member 54 are pulled in the lengthwise direction of the shield case 55, the holding member 53 can be slid in the groove 62 and moved in the lengthwise direction of the shield case 55 under guidance provided by the groove 62. That is, the cleaning members 52*a* and 52*b* supported by the holding member 53 can be passed through the corona electrode 50 in contact therewith to rub the electrode. Thus, the corona electrode 50 can be cleaned without removing the charging apparatus 24*a* from the image forming apparatus 1 or opening the image forming apparatus 1.

The charging apparatus 24*a* includes the corona electrode 50 and the cleaning mechanism. The corona electrode 50 exhibits high durability against ozone and moisture in the air, and it is capable of charging the surface of the photoreceptor drum 23 uniformly and stably throughout the life of the image forming apparatus 1. In addition, the manufacturing cost is low. The cleaning mechanism efficiently cleans the surface of the corona electrode 50. Therefore, the corona electrode 50 of the charging apparatus 24*a* discharges toward the surface of the photoreceptor drum 23 with higher stability, and the surface of the photoreceptor drum 23 can be stably charged at a predetermined electrical potential having a predetermined polarity even if there are some changes in environmental conditions.

EXAMPLE

The technology will now be more specifically described with reference to an example for reference, preferred examples, and a comparative example.

Reference Example 1

A sheet metal (having dimensions of 20 mm×310 mm×0.1 mm (thickness)) made of stainless steel (SUS304) was masked and etched by spraying an aqueous solution of a ferric chloride of 30% by weight at a temperature of 90° C. for two hours. The sheet metal was further washed with water and pure water to fabricate a grid electrode having a plurality of through holes. A grid electrode as shown in FIG. 7 was obtained, in which the opening had a width W1 of 325.5 mm in the lengthwise direction. The overall length of the electrode in the lengthwise direction was 364 mm. The opening had a width W2 of 12 mm in the widthwise direction. The overall width length of the electrode in the widthwise direction thereof was 14 mm. The angle of inclination of the through holes in the opening to the lengthwise direction of the grid electrode was 45°. The width of the through holes in the lengthwise direction of the grid electrode was 0.3 mm. A metal part between each couple of adjoining through holes had a width of 0.1 mm in the lengthwise direction of the grid electrode.

Example 1

A sheet metal (having dimensions of 20 mm×310 mm×0.1 mm (thickness)) made of stainless steel (SUS304) was masked and etched by spraying an aqueous solution of a ferric chloride of 30% by weight at a temperature of 90° C. for two hours. The sheet metal was further washed with water and pure water to fabricate a corona electrode substrate. A Ni plating layer was formed on a surface of the corona electrode substrate using the electroplating apparatus 70 shown in FIG. 4, the plating layer had a thickness of 0.5 μm and extended a length of 1 mm from the tops of tip parts 58*b* of pointed projections 58*a*. Then, the corona electrode substrate formed with a Ni plating layer was mounted in the electroplating apparatus 70 shown in FIG. 4, and PTFE-containing nickel plating was performed to fabricate a corona electrode 50 to be used in the present technology. The electro nickel plating bath 71 was composed of 300 g/liter nickel sulfate, 50 g/liter nickel chloride, 35 g/liter boric acid, 2 g/liter PTFE particles (having a volumetric average particle diameter of 1 μm), and the plating bath had a pH value of 4. Referring to plating conditions, the plating bath temperature was 65° C.

PTFE-containing nickel plating layers provided on the tip parts 58*b* of the pointed projections 58*a* of the resultant corona electrode 50 had a thickness of 5 μm and extended a length of 1 mm from the tops of the tip parts 58*b* of the pointed projections 58*a*. In the resultant corona electrode 50, the flat plate section had a length L1 of 10 mm in the widthwise direction thereof, a length L2 of 2 mm in the projecting direction of the pointed projections, a radius of curvature of 40 μm at the tips of the pointed projections, and a pitch TP of 2 mm between the pointed projections.

Example 2

A sheet metal (having dimensions of 20 mm×310 mm×0.1 mm (thickness)) made of stainless steel (SUS304) was masked and etched by spraying an aqueous solution of a ferric chloride of 30% by weight at a temperature of 90° C. for two hours. The sheet metal was further washed with water and pure water to fabricate a corona electrode substrate. A Ni plating layer was formed on a surface of the corona electrode substrate using the electroplating apparatus 70 shown in FIG. 4, the plating layer had a thickness of 0.5 μm and extended a length of 1 mm from the tops of tip parts 58*b* of pointed projections 58*a*. Then, the corona electrode substrate formed with a Ni plating layer was mounted in the electroplating apparatus 70 shown in FIG. 4, and gold plating was performed to fabricate a corona electrode 50 to be used in the present technology. The gold plating bath 71 was composed of 10 g/liter gold hydroxide, 100 g/liter 1,2-ethanediamine dihydrochloride, 35 g/liter boric acid, and 5 mg/liter 2,2-bipyridyl, and the plating bath had a pH value of 3.8. Referring to plating conditions, the plating bath temperature was 65° C.

Gold layers provided on the tip parts 58*b* of the pointed projections 58*a* of the resultant corona electrode 50 had a thickness of 1 μm and extended a length of 1 mm from the tops of the tip parts 58*b* of the pointed projections 58*a*. In the resultant corona electrode 50, the flat plate section had a length L1 of 10 mm in the widthwise direction thereof, a length L2 of 2 mm in the projecting direction of the pointed projections, a radius of curvature of 40 μm at the tips of the pointed projections, and a pitch TP of 2 mm between the pointed projections.

Comparative Example 1

The same process as in Example 1 was performed except that pointed projections 58*a* were entirely immersed in the plating bath to fabricate a corona electrode for comparison having a nickel plating layer and a PTFE-containing nickel plating layer provided on the entire pointed projections 58*a*.

A charging apparatus and an image forming apparatus were fabricated by replacing corona electrodes of charging apparatus in image forming apparatus available in the market (product designation: AR625 manufactured by Sharp Corporation) with the corona electrodes obtained in Examples 1 and 2 and Comparative Example 1. The following tests were conducted on the image forming apparatus.

[Discharge Test]

An aging test was conducted without feeding paper under a severe humidity condition (10% or lower). Since AR625 is a machine printing 70 copies/minute, the period of 71 hours corresponds to the number of copies to print (300,000 copies/life). An initial charging potential on the surface of the photoreceptors under the test was set at −630 V.

[Detection of Nitrogen Oxides and Rust]

Rust and nitrogen oxides were detected by observing the corona electrodes with a microscope after discharge.

As a result, no rust was observed on the surface of the corona electrodes of Examples 1 and 2 and Comparative Example 1. All of the image forming apparatus having the charging apparatus including the corona electrodes of Examples 1 and 2 and the Comparative Example 1 produced uniform halftone images without unwanted white and black lines and other irregularities even after printing 300,000 copies of halftone images. That is, it was found that the corona electrodes of Examples 1 and 2 were comparable in performance with the corona electrode of Comparative Example 1 having a PTFE-containing nickel plating layer on the entire surface of the pointed projections.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

The invention claimed is:

1. A charging apparatus which is to be incorporated into an image forming apparatus having a photoreceptor drum, for forming an image by an electrophotographic method, comprising:

a corona electrode having a pointed projection section with pointed projections for charging a surface of the photoreceptor drum by applying a voltage to the surface through corona discharge and having a coating layer containing a material different from the electrode material of which the corona electrode is formed, the coating layer being provided only on the tips of the pointed projections;

a first power supply for applying a voltage to the corona electrode;

a shield case provided around the corona electrode at an interval from the same to cover at least part of the periphery of the corona electrode excluding the region of a gap between the corona electrode and the photoreceptor drum;

a grid electrode provided between the photoreceptor drum and the corona electrode; and a second power supply for applying a voltage to the grid electrode.

2. The charging apparatus of claim 1, wherein the corona electrode is formed of an electrode material which is selected from among nickel, stainless steel, iron, copper, and a copper alloy.

3. The charging apparatus of claim 1, wherein the corona electrode includes a flat plate section extending to be long in one direction and wherein the pointed projection section is formed to project from one widthwise end face of the flat plate section, to the widthwise direction.

4. The charging apparatus of claim 1, wherein the coating layer is provided only on a corona discharge area of the pointed projection section and on the neighborhood of the area.

5. The charging apparatus of claim 1, wherein the coating layer is a nickel layer containing polytetrafluoroethylene particles.

6. The charging apparatus of claim 1, wherein the coating layer is a layer of gold.

7. An image forming apparatus for forming an image by an electrophotographic method, comprising:

a photoreceptor drum having a photosensitive layer for forming an electrostatic latent image on a surface thereof;

a charging section for charging the surface of the photoreceptor drum, the charging section being the charging apparatus of claim 1;

an exposure section for forming an electrostatic latent image on the surface of the photoreceptor according to image information;

a developing section for supplying toner to the electrostatic latent image on the photoreceptor surface to form a toner image;

a transfer section for transferring the toner image on the photoreceptor surface onto a recording medium; and a fixing section for fixing the toner image on the recording medium.

8. The charging apparatus of claim 1, wherein the coating layer covers less than approximately 50% of the total height of the pointed projections from the top of the tip part of the pointed projections downward.

9. The charging apparatus of claim 1, wherein the coating layer covers less than approximately 33% of the total height of the pointed projections from the top of the tip part of the pointed projections downward.

* * * * *